US009206597B2

(12) United States Patent
Marsh et al.

(10) Patent No.: US 9,206,597 B2
(45) Date of Patent: Dec. 8, 2015

(54) UNITIZED POST TENSION BLOCK SYSTEM FOR MASONRY STRUCTURES

(75) Inventors: Roger F. Marsh, Alexandria, IN (US); Patricia M. Marsh, Alexandria, IN (US)

(73) Assignee: 3B CONSTRUCTION SOLUTIONS, INC., Anderson, IN (US)

( * ) Notice: Subject to any disclaimer, the term of this patent is extended or adjusted under 35 U.S.C. 154(b) by 0 days.

(21) Appl. No.: 11/353,253

(22) Filed: Feb. 13, 2006

(65) Prior Publication Data

US 2007/0186502 A1 Aug. 16, 2007

(51) Int. Cl.
*E04C 5/08* (2006.01)
*E04B 2/16* (2006.01)
*E04B 2/02* (2006.01)

(52) U.S. Cl.
CPC ..... *E04B 2/16* (2013.01); *E04B 2002/0254* (2013.01)

(58) Field of Classification Search
CPC ..... E04B 2/16; E04B 2002/0254
USPC ..... 52/223.7, 293.2, 564, 565, 740.1, 604, 52/600, 607, 719, 285.2, 223.5, 253, 247, 52/431, 570
See application file for complete search history.

(56) References Cited

U.S. PATENT DOCUMENTS

| | | | | | |
|---|---|---|---|---|---|
| 838,844 | A | * | 12/1906 | Clayton | 52/565 |
| 952,305 | A | | 3/1910 | Buskirk | |
| 962,463 | A | | 6/1910 | Phillips | |
| 1,753,451 | A | * | 4/1930 | Tonnelier | 52/564 |
| 1,783,383 | A | | 12/1930 | Montrief | |
| 1,892,605 | A | | 12/1932 | Betzler | |
| 2,141,397 | A | | 12/1938 | Locke | |
| 2,212,184 | A | | 8/1940 | Powell | |
| 2,250,763 | A | * | 7/1941 | Hild | 52/279 |
| 2,929,236 | A | | 3/1960 | Steward et al. | |
| 2,963,828 | A | | 12/1960 | Belliveau | |
| 3,236,545 | A | | 2/1966 | Parkes et al. | |
| 3,295,286 | A | | 1/1967 | Schaich | |
| 3,296,758 | A | * | 1/1967 | Knudsen | 52/223.7 |
| 3,382,632 | A | | 5/1968 | Grofcsik | |
| 3,410,044 | A | | 11/1968 | Moog | |
| 3,511,000 | A | | 5/1970 | Keuls | |
| 3,763,609 | A | | 10/1973 | Probst | |

(Continued)

OTHER PUBLICATIONS

"Embed" and "contiguous," Webster's Dictionary.*

(Continued)

*Primary Examiner* — Chi Q Nguyen
(74) *Attorney, Agent, or Firm* — C. John Brannon; Brannon Sowers & Cracraft PC

(57) ABSTRACT

An improved mortar less masonry structure comprising a plurality of concrete masonry units connected to each other by metal bars and metal threaded fasteners thereby forming a reinforcing skeletal system for a post tensioned structure. The improved system has been developed for use in constructing various types of masonry structures. The improvements of the system feature masonry units with recessed channels, pocket channels, or fully embedded bars as anchors. The bolt acts as the tendon for the post tensioning system which traverse the hollow cavities as ducts. Other new features teach a strong and durable full plate anchor and high strength tendons for defensive and anti-terrorism structures. This is an improved building system that demountably couples each individual masonry unit by a bar and bolt system. This coupling results in stronger, faster, and cheaper construction of masonry structures.

23 Claims, 19 Drawing Sheets

(56) References Cited

U.S. PATENT DOCUMENTS

Figures 1, 1C, 1D:
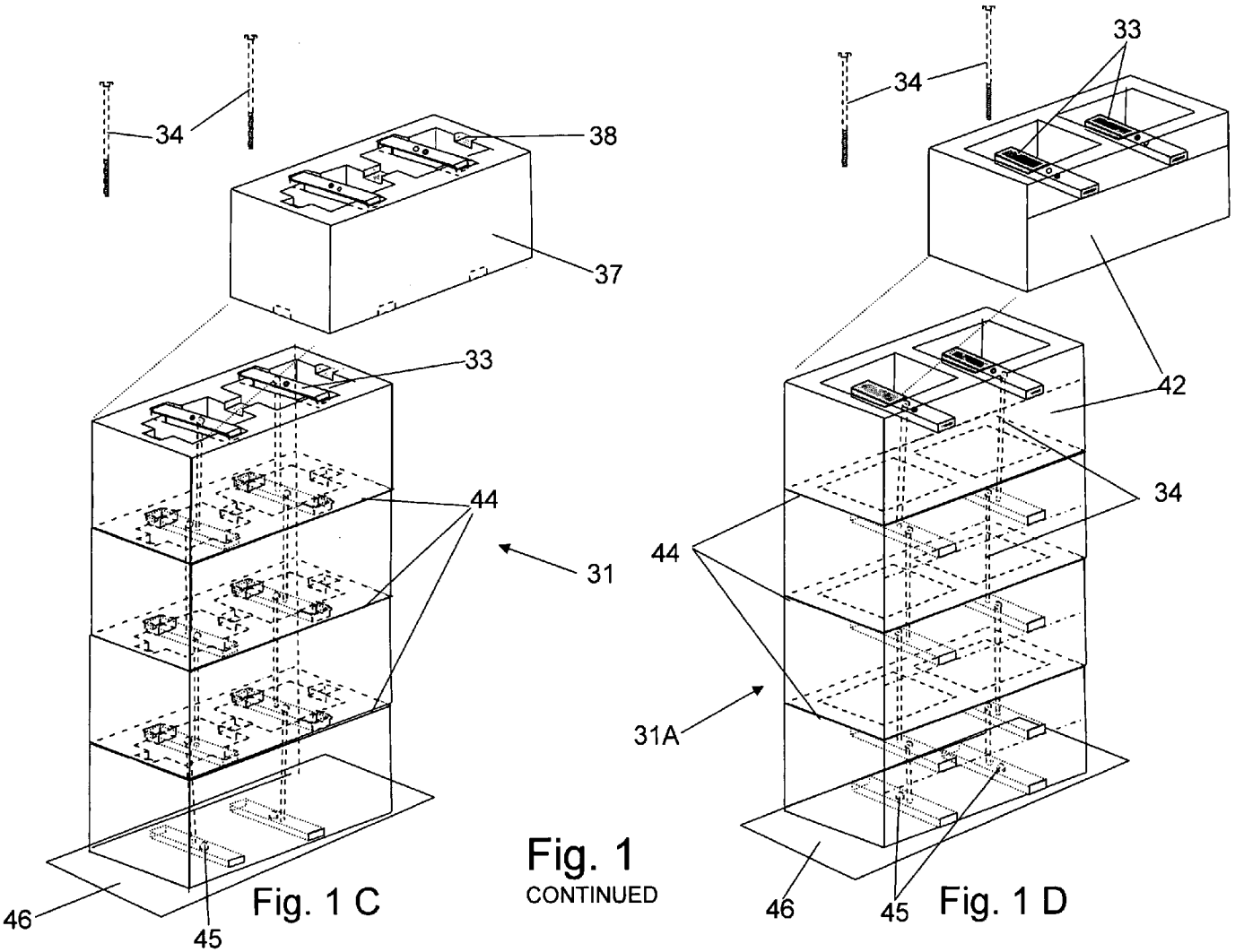

| | | | | |
|---|---|---|---|---|
| 3,785,097 | A | 1/1974 | Seymour | |
| 4,094,222 | A | 6/1978 | Lang et al. | |
| 4,569,167 | A | 2/1986 | Staples | |
| 4,640,071 | A | 2/1987 | Haener | |
| 4,726,567 | A | 2/1988 | Greenberg | |
| 4,757,656 | A | 7/1988 | Powers, Jr. | |
| 4,854,097 | A | 8/1989 | Haener | |
| 5,007,218 | A | 4/1991 | Bengtson et al. | |
| 5,511,902 | A | 4/1996 | Center | |
| 5,589,124 | A | 12/1996 | Woolford et al. | |
| 5,802,792 | A | 9/1998 | Fielding et al. | |
| 5,809,732 | A | 9/1998 | Farmer, Sr. et al. | |
| 5,924,254 | A | 7/1999 | Franklin et al. | |
| 5,941,565 | A | 8/1999 | Clendenin, Jr. | |
| 6,065,265 | A | 5/2000 | Stenekes | |
| 6,098,357 | A | 8/2000 | Franklin et al. | |
| 6,138,426 | A | 10/2000 | Mork et al. | |
| 6,167,669 | B1 | 1/2001 | Lanc | |
| 6,178,714 | B1 | 1/2001 | Carney, Jr. | |
| 6,244,785 | B1 | 6/2001 | Richter et al. | |
| 6,282,859 | B1 | 9/2001 | Van Der Heijden | |
| 6,321,498 | B1 | 11/2001 | Trovato | |
| 6,431,797 | B2 | 8/2002 | Greenberg | |
| 6,513,296 | B1 | 2/2003 | Baden | |
| 6,557,316 | B2 | 5/2003 | Van Der Heijden | |
| 6,632,048 | B2 * | 10/2003 | Greenberg | 405/284 |
| 6,665,992 | B2 | 12/2003 | Hew | |
| 6,691,471 | B2 | 2/2004 | Price | |
| 6,758,020 | B2 | 7/2004 | Cerrato | |
| 6,904,728 | B2 | 6/2005 | Stutts | |
| 6,915,614 | B2 | 7/2005 | Matsufuji | |
| 6,955,015 | B2 | 10/2005 | Manthei | |
| 7,124,550 | B1 | 10/2006 | Deming | |
| 7,415,805 | B2 | 8/2008 | Nickerson | |
| 7,461,490 | B2 | 12/2008 | Toledo | |
| 2002/0041796 | A1 | 4/2002 | Greenberg | |
| 2002/0134040 | A1 | 9/2002 | Hew | |
| 2004/0020145 | A1 | 2/2004 | Matsufuji | |
| 2004/0144059 | A1 | 7/2004 | Keshmiri | |
| 2005/0183362 | A1 | 8/2005 | McCarthy | |
| 2006/0168906 | A1 | 8/2006 | Tonyan et al. | |
| 2006/0201082 | A1 | 9/2006 | Hammer et al. | |
| 2007/0017176 | A1 | 1/2007 | Gray | |
| 2007/0056235 | A1 | 3/2007 | Kohler | |
| 2007/0107333 | A1 | 5/2007 | Marsh | |
| 2007/0186502 | A1 | 8/2007 | Marsh | |
| 2008/0256894 | A1 | 10/2008 | Marsh et al. | |

OTHER PUBLICATIONS

U.S. Appl. No. 11/271,703, filed Nov. 10, 2005, Roger Marsh et al.
"Embed" and "Contiguous" Webster's Dictionary.
Canadian Intellectual Property Office, Examination Report, Application No. 2,627,760, Nov. 4, 2009.
Canadian Intellectual Property Office, Examination Report, Application No. 2,642,393, Mar. 15, 2010.
International Search Report and Written Opinion of the International Searching Authority, PCT/US06/17364, Aug. 7, 2007.
International Search Report and Written Opinion of the International Searching Authority, PCT/US06/17523, Sep. 18, 2007.
International Search Report and Written Opinion of the International Searching Authority, PCT/US08/060913, Aug. 21, 2008.
International Search Report and Written Opinion of the International Searching Authority, PCT/US07/082488, Sep. 9, 2008.
Danish Patent and Trademark Office Singapore Written Opinion, Application No. 200803325-0, Apr. 22, 2009.
Australian Government, IP Australia, Intellectual Property Office of Singapore, Written Opinion, Application No. 200805986-7, mailed Jul. 21, 2009.
Hungarian Patent Office, Intellectual Property Office of Singapore. Written Opinion, Application No. 2009028671, mailed Apr. 15, 2010.
State Intellectual Property Office of the People's Republic of China, Office Action, Application No. 200680053837.6, mailed Apr. 1, 2010.
State Intellectual Property Office of the People's Republic of China , Office Action, Application No. 200680042078.3, mailed Dec. 25, 2009.

* cited by examiner

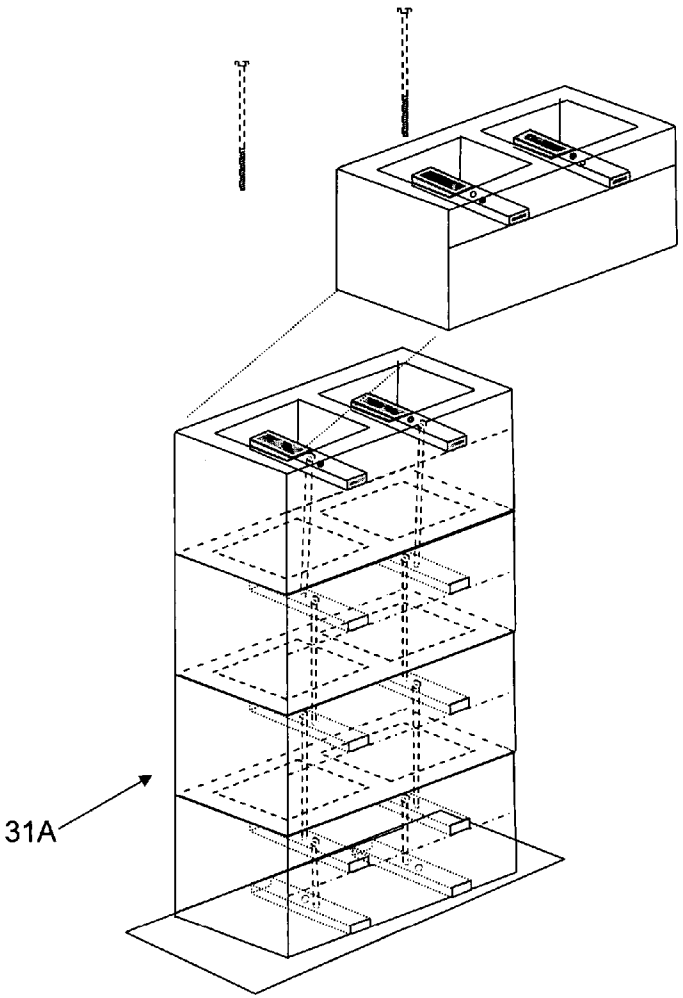
Fig. 1 B
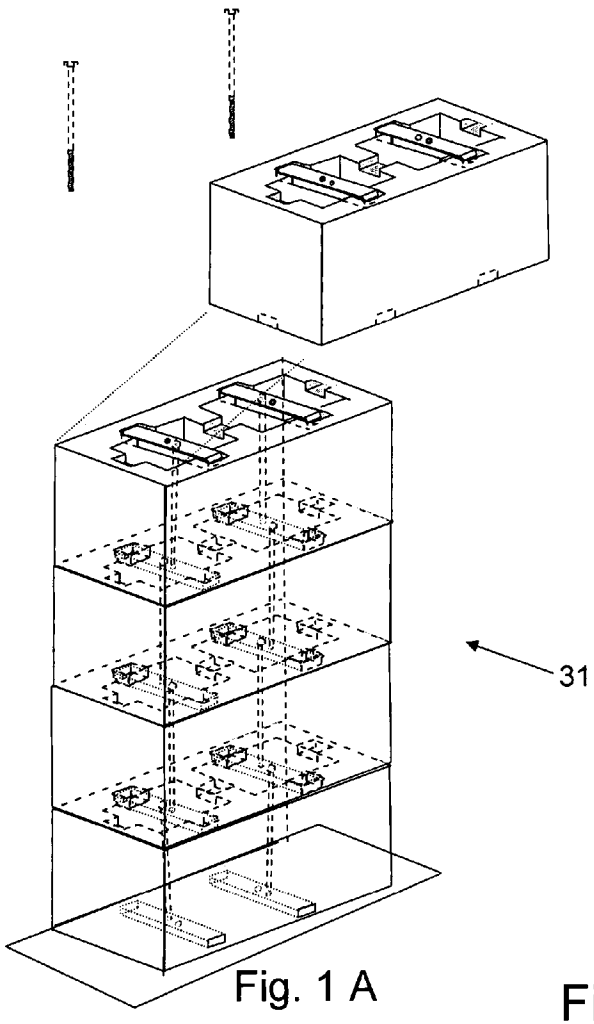
Fig. 1 A
Fig. 1

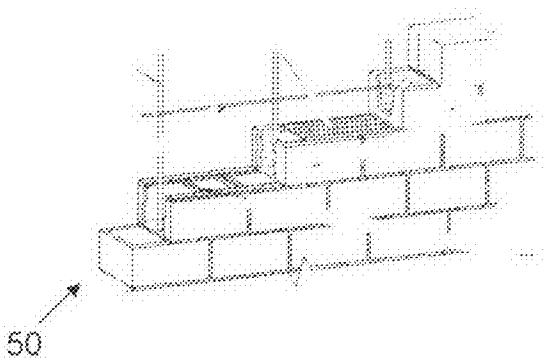
Fig. 4 C
PRIOR ART
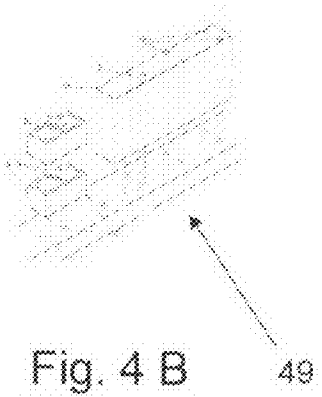
Fig. 4 B
PRIOR ART
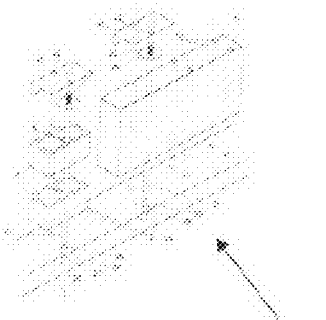
Fig. 4 A
PRIOR ART
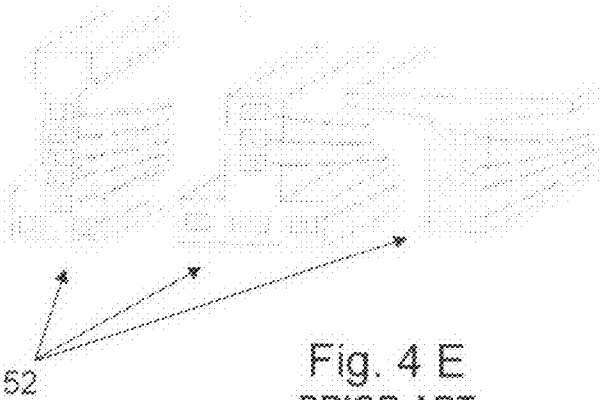
Fig. 4 E
PRIOR ART
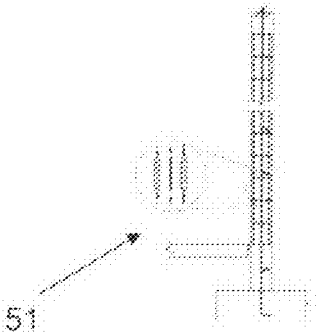
Fig. 4 D
PRIOR ART
Fig. 4

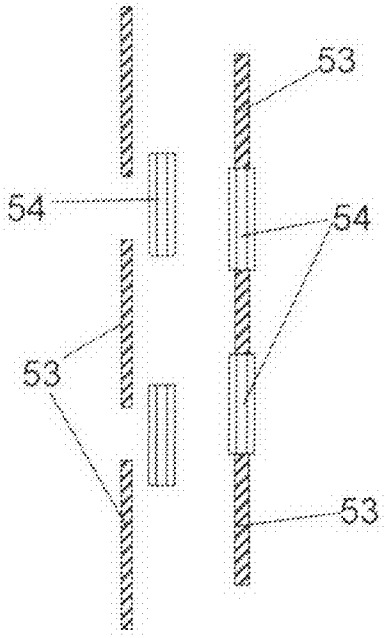
Fig. 5 A
PRIOR ART
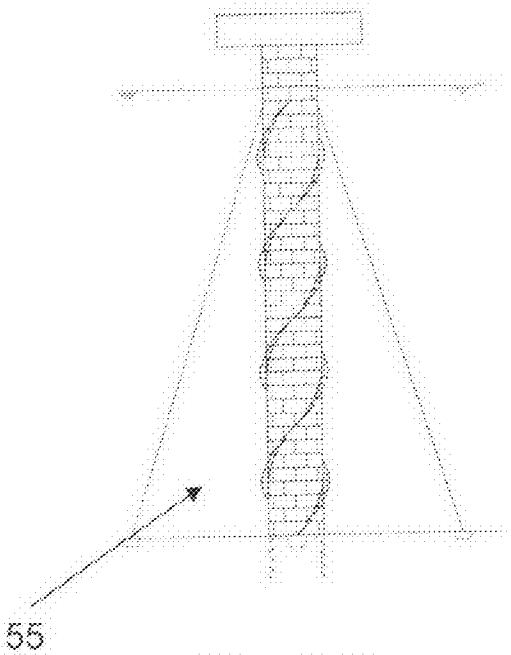
Fig. 5 B
PRIOR ART
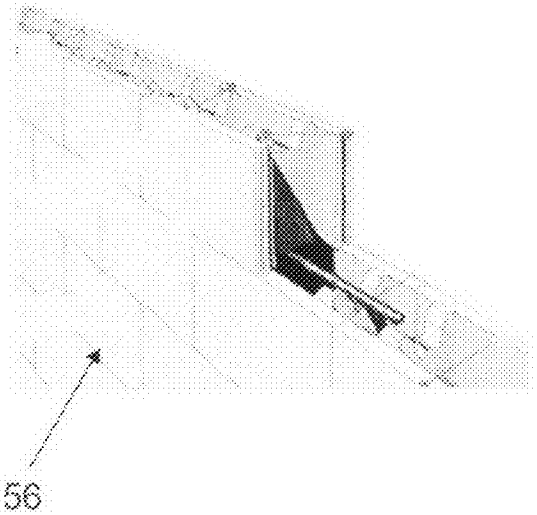
Fig. 5 C
PRIOR ART
Fig. 5

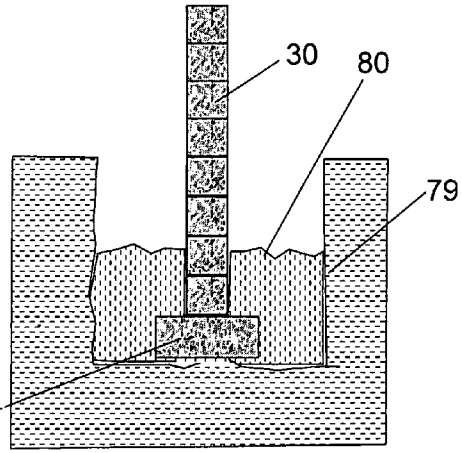
Fig. 14 B
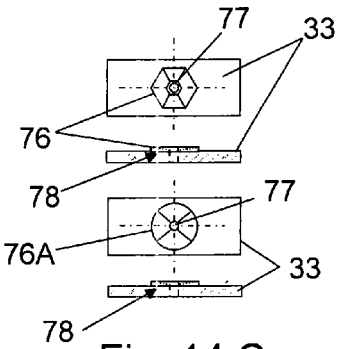
Fig. 14 C
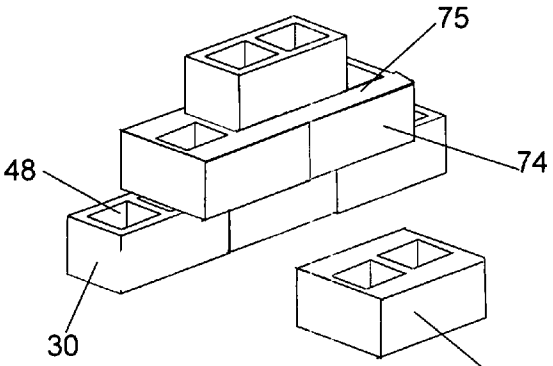
Fig. 14 A
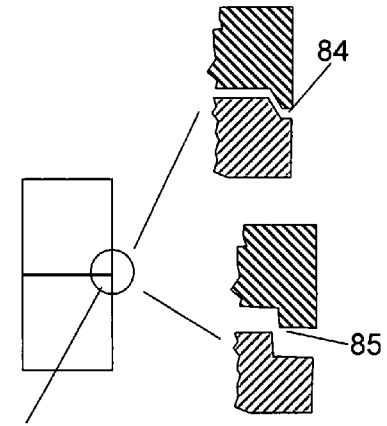
Fig. 14 F
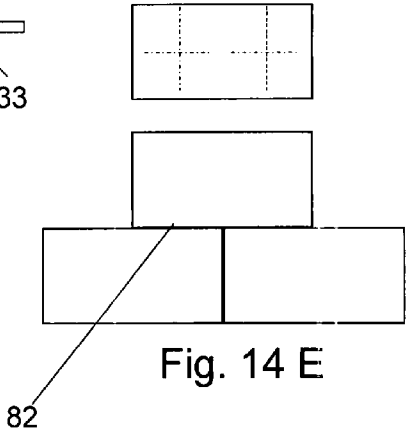
Fig. 14 E
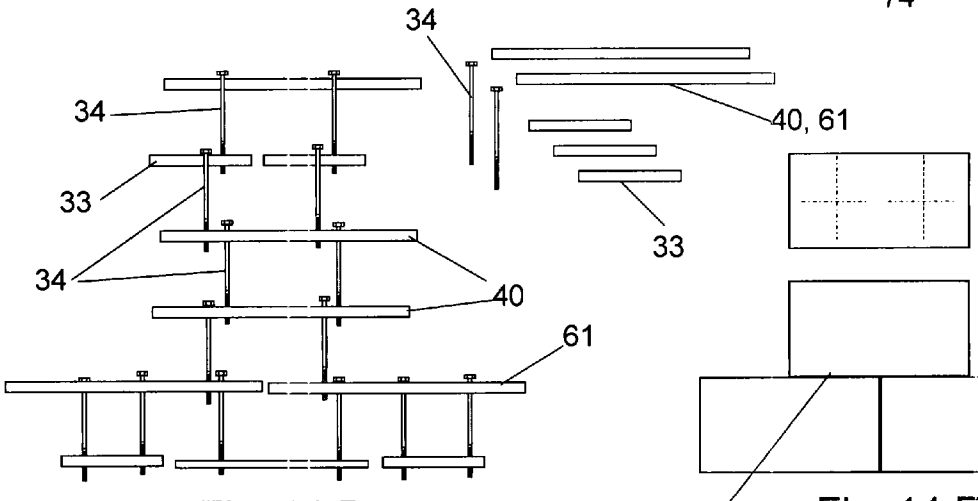
Fig. 14 D
Fig. 14

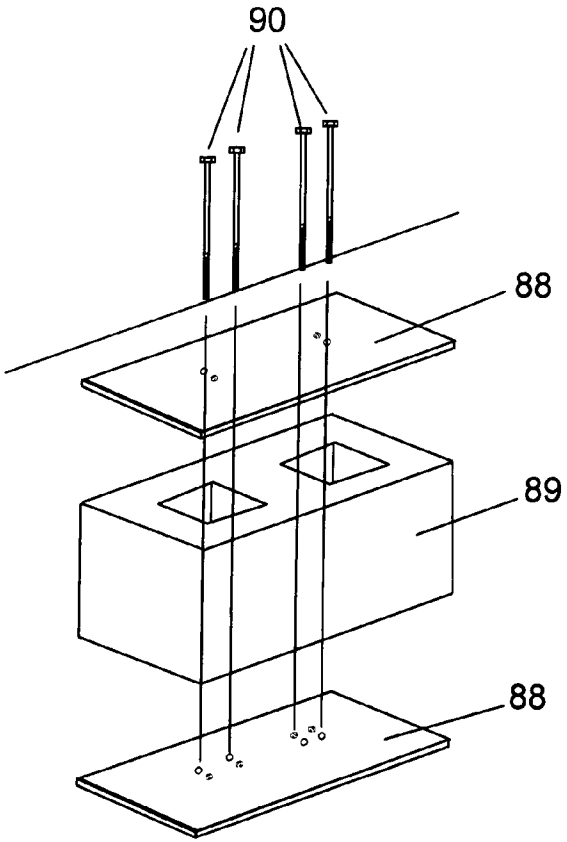
Fig. 16 B
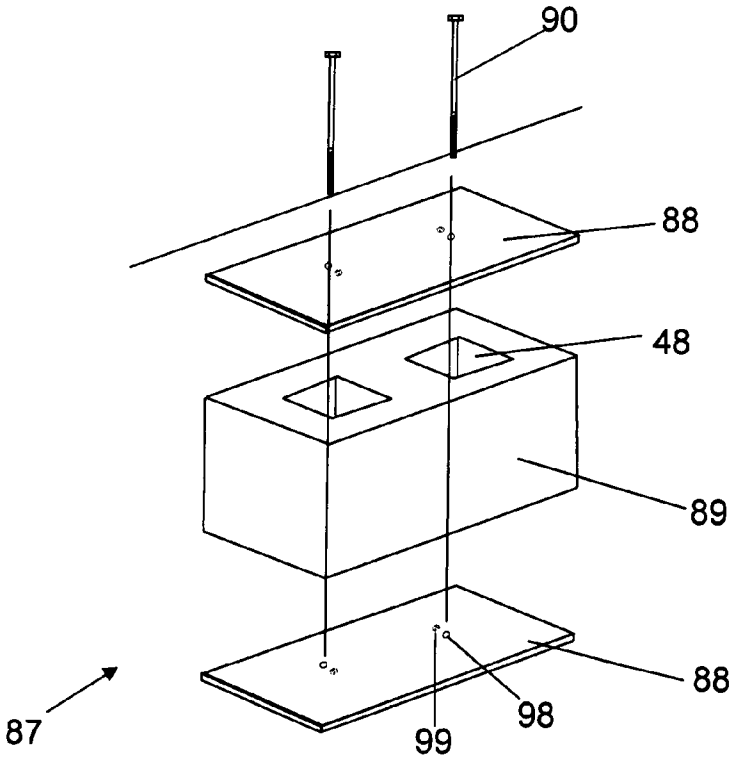
Fig. 16 A
Fig. 16

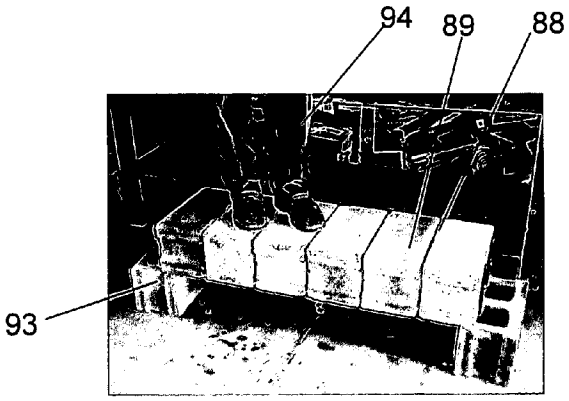
Fig. 18 B
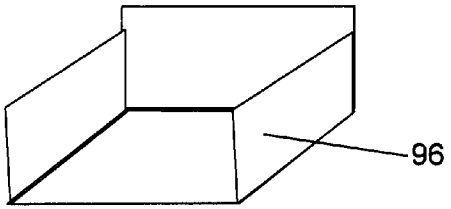
Fig. 18 D
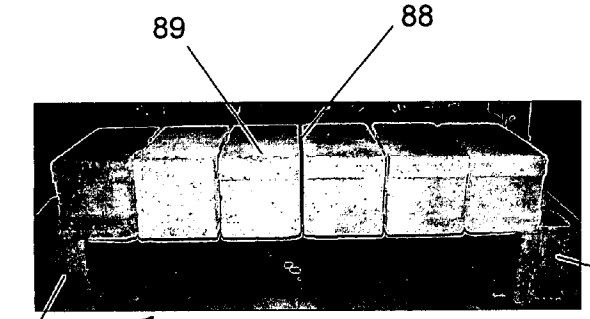
Fig. 18 A
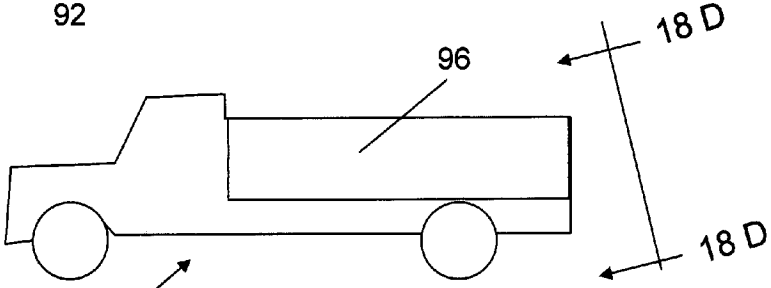
Fig. 18 C
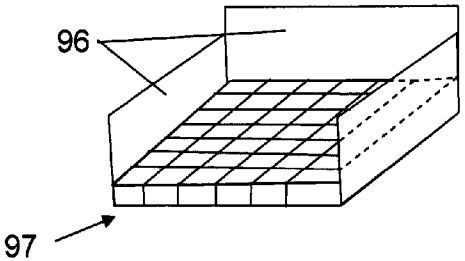
Fig. 18 E
Fig. 18

UNITIZED POST TENSION BLOCK SYSTEM FOR MASONRY STRUCTURES

CROSS-REFERENCE TO RELATED APPLICATIONS

Not Applicable. The underlying engineering concept of the system is that of post tensioning reinforcement of Concrete Masonry Units. It is believed that the first teaching of the post tensioning system was by the Bolt-A-Block system which was filed Nov. 10, 2005 by Roger Marsh et al (the same inventors) with Ser. No. 11/271,703. What the present invention entails is significant new features and improvements to the block system and features of assembly not shown or present in the Bolt-A-Blok system.

FIELD OF INVENTION

This invention relates to a unitized masonry structure, particularly structures with post tensioned reinforcement. The present invention relates generally to all types of general construction where a common mortar and hollow block or brick combination is utilized and relates to other construction means for structures as well.

FEDERALLY SPONSORED RESEARCH

Not Applicable.

SEQUENCE LISTING OR PROGRAM

Not Applicable.

BACKGROUND—FIELD OF INVENTION

The new unitized masonry structure described in this specification is a construction system that is designed to easily and quickly install in any location without the need for mortar, water, or power. In the United States alone there are over 4000 block manufacturing companies. Traditionally, building blocks and bricks are attached to each other by either of two methods. The first is by gravity, which includes stacking, arches, and flying buttresses. The second is by mortar and mortar equivalent methods, such as various types of mortar, epoxy, or blocks having their cores filled with concrete, with or without reinforcing steel bars (rebars). This attachment usually includes mortar with reinforcing wire in the joints and also includes attachment between masonry units with concrete and rebars in such shapes as bond beam blocks and pier blocks.

When reinforcement means have been used with block, it is typically accomplished with either long rebars or long steel rods or stranded cables placed in the cavities called ducts. The usual reinforcement is without any tensioning of the steel reinforcement, either pre-tensioning or post tensioning. Pre and post tensioning, as one well skilled in the art of construction engineering and techniques knows, increases the overall strength of the concrete unit. Until recently, post tensioning has only been used with a complete stack of block in conjunction with the placement of mortar between each layer. Up to now, most specialty block systems with rods and plates have required very complex design and high levels of skill by construction designers and engineers.

In the latter months of 2005, a newer technique of a bolt, block and bar system—called Bolt-A-Blok—introduced a basic unitized post tensioning where a loose bar is utilized as an anchor across the hollow cavity (or duct) of a concrete masonry unit (CMU) or block. The bar (anchor) has apertures with and without threads which are then individually connected by a through bolt which is essentially the tendon. The bolt (tendon) and bar (anchor) network required some care in the placement of the bar to assure uniformity of the reinforcement web of the tendons and anchors. The improved method and system described in this new system called a UNITIZED POST TENSION BLOCK SYSTEM FOR MASONRY STRUCTURES has been devised that essentially "locates" the bars uniformly in a recessed cavity or in a pocket of the concrete masonry unit (CMU). Another embodiment of the new system eliminates bar placement entirely by embedding the bars into the CMU during the manufacturing of the block. These new configurations eliminate any gap between the adjacent CMUs. No filling or caulking of the space is required. Various other embodiments and improvements are described which greatly enhance the post tensioning system first introduced under the Bolt-A-Blok system established as prior art.

A. Introduction of the Problems Addressed

Since most masonry structures use mortar, several things are required. First, the mortar requires water. Second, in most cases, the laying of block requires a skilled block or brick mason. Third, a means of power to mix the mortar is normal. Fourth, elaborate bracing and reinforcement is needed until the mortar cures and reaches its strength. During this curing time the overall structure is "fragile" to wind, severe temperatures, and other natural weather and environmental conditions. During curing, occupation and use of the structure is unwise. Scaffolding often remains in place awaiting some cure before additional blocks are added to the height of the structure. If proper preparation and care are not provided to reduce the environmental impacts, the mortar and overall structure may result in cracking and diminished structural strength.

Reinforcing means 51 are often provided to improve strength (as shown in FIG. 4D), but the need to have bracing and other protection in place for many days and even weeks is still needed. Traditional masonry structures which use mortar often have straight sections 50 which are staggered and have wire mesh and an occasional rebar (as shown in FIG. 4 C).

Finally, once built, the traditional masonry systems become a fixed structure. Unless very special and complex features provisions are added to the normal block, rebar and mortar system, the structure is essentially not re-useable and must be "demolished" to be removed.

These stated requirements each limit the use of the traditional masonry with mortar system. The new system called Bolt-A-Blok facilitated a clear improvement to traditional construction systems and their limitations. The Bolt-A-Blok system does not require special skills to construct; does not need water and power; does not require elaborate bracing; provides immediate occupancy or use; needs no curing time; and, is re-useable if desired since it is not destroyed when disassembled and moved. Bolt-A-Blok system was an improvement to decrease the time to build or rebuild areas with minimal skilled labor. The Bolt-A-Blok system provides a far superior and more consistent strength structure than the traditional mortar constructed structure.

While the Bolt-A-Blok system addressed many of the common requirements and limitations to traditional mortar and block construction methods, the system has some room for improvement. These improvements are addressed by the UNITIZED POST TENSION BLOCK SYSTEM FOR MASONRY STRUCTURES described below. The improvements over Bolt-A-Blok include:

a. elimination of any gap between the CMUs. No filling or caulking of the space is required.
b. precise placement of the anchor bar.
c. faster build time with the recessed channels or the embedded bars.
d. commercial tracking of the invention with the embedded bars.
e. stronger military/defense use and anti-blast applications.
f. features for easier, faster build with placement aids.
g. features with anti-turn and quick connections with oval plates/washers and threaded tendons.

B. Prior Art

Historically, few patented devices have attempted to address the problem as stated. The building industry has made little progress for a unitized, post tension system. Even so, blocks have required very special and often complex configurations to even handle rods and plates and then the have taught only limit rods in special blocks. One such device is described in U.S. Pat. No. 5,511,902 (1996) issued to Center which teaches an Instant levy block system. This is a complex, specially made block for constructing a levy, comprising a plurality of blocks, a plurality of connecting pegs, and a plurality of stakes. Each part is uniquely designed and made whereas the new UNITIZED POST TENSION BLOCK SYSTEM FOR MASONRY STRUCTURES as described here utilizes a uniform, readily available block design for a concrete masonry unit (CMU).

Another block device is described in A U.S. Pat. No. 5,809,732 which was issued to Farmer, Sr. et al (1998) which teaches a masonry block with an embedded plate. The concrete masonry block has an external plate or plates that are anchored through the concrete masonry block. The external plates are cast into the concrete masonry block in the mold during casting. These plates and metal pieces are not taught as being part of a post tensioning system now shown cast within the hollow cavities as addressed by the new UNITIZED POST TENSION BLOCK SYSTEM FOR MASONRY STRUCTURES.

Another device for construction is taught by U.S. Pat. No. 6,098,357 issued to Franklin et al. (2000). This art discloses a modular pre-cast construction block system with a wall subsystem and a foundation subsystem. The wall subsystem has a number of wall units having cavities and pre-stressed tension cables are cast therein the cavity. This teaches precast walls and pass through cable which are specially made, require water, and are not readily re-useable like the UNITIZED POST TENSION BLOCK SYSTEM FOR MASONRY STRUCTURES. Also, the tensioning system is not unitized or placed throughout the entire structure.

A somewhat re-useable system 49 is taught in the U.S. Pat. No. 6,178,714 issued to Carney, Jr. (2001) (as shown in FIGS. 4A and 4B). The long rods go through apertures in the specially cast block and the precast structures. No description of pre or post tensioning is taught or claimed. The configuration of special length rods, special blocks, special plates and a complex system that requires powered equipment to construct is unlike the simple components of the UNITIZED POST TENSION BLOCK SYSTEM FOR MASONRY STRUCTURES.

A Mortar less wall structure is taught in U.S. Pat. No. 6,691,471 issued to Price (2004). Here a wall structure comprising of columns of preformed, lightweight, stacked blocks, with the columns of blocks connected to each other by elongated, vertically oriented, support beams. Preferably, the wall structure is operatively connected to a structure by one or more brackets. The beams and blocks are special configuration, not readily available and with limited uses.

A pre-cast, modular spar system having a cylindrical open-ended spar 55 of relatively uniform cross section is taught in a U.S. Pat. No. 6,244,785 issued to Richter, et al (2001) (as shown in FIG. 5 B). The spar sections are formed by joining arcuate segments and stacking the sections. No design is shown that anticipates this UNITIZED POST TENSION BLOCK SYSTEM FOR MASONRY STRUCTURES.

An interlocking, mortar less system is accomplished by some other devices. However, none of them are found to show a structural unitized post tensioning system as described for the UNITIZED POST TENSION BLOCK SYSTEM FOR MASONRY STRUCTURES in the materials below. An example of one such interlocking device 56 is taught by U.S. Pat. No. 4,640,071 issued to Haener (1987). This is shown as FIG. 5 C and teaches a block of concrete or the like for use in constructing a mortar less wall. The device provided includes a spaced parallel pair of upright sidewalls having flat bottoms and tops and bearing integral block interlocking connectors and various configurations on their opposite ends. The sidewalls are integrally connected by means of these configurations. This is not the configuration taught by the UNITIZED POST TENSION BLOCK SYSTEM FOR MASONRY STRUCTURES. Likewise, no post tensioning is taught to increase the structural integrity and strength.

Figure 3:
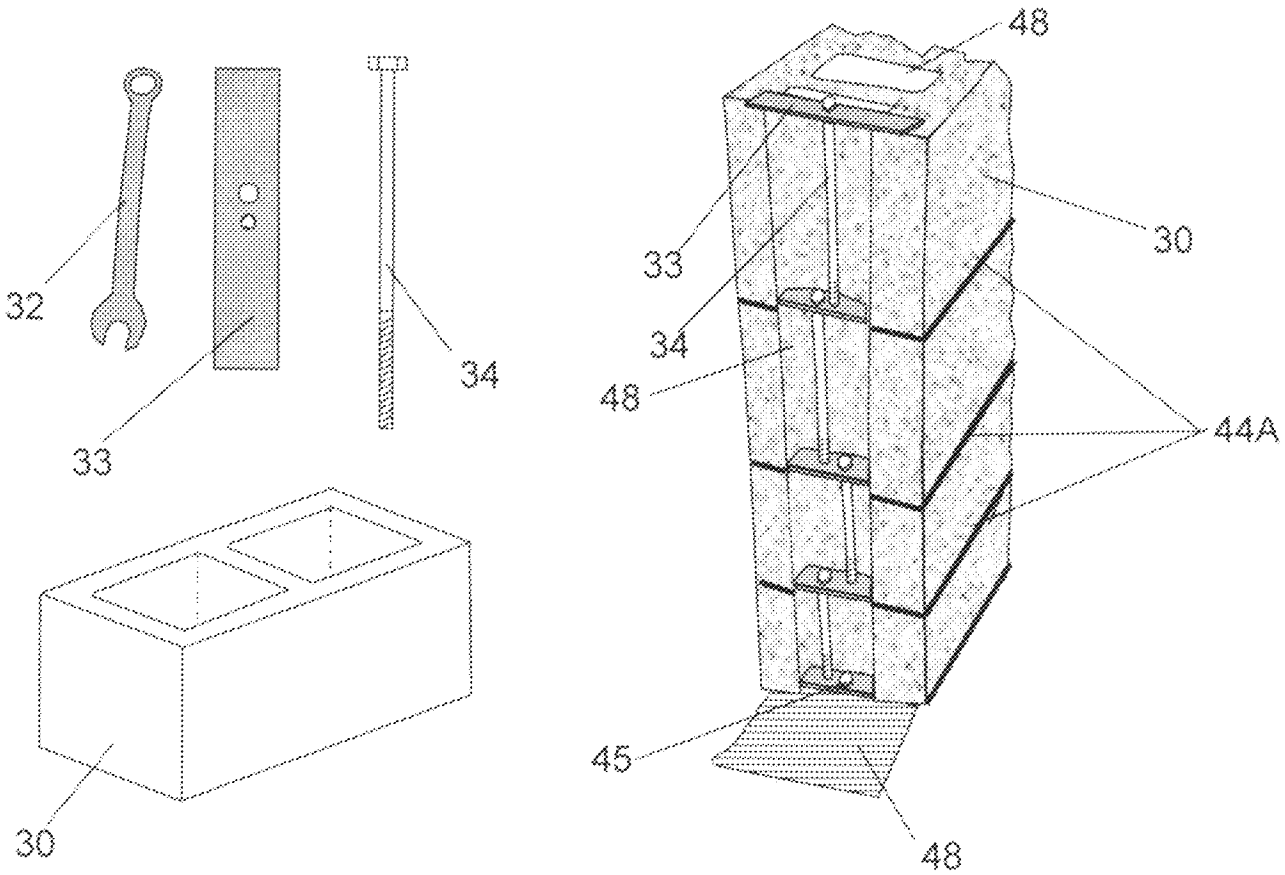
Fig. 3 PRIOR ART

The Bolt-A-Block system was filed Nov. 10, 2005 by Roger Marsh et al with Ser. No. 11/271,703. This basic mortar less system taught a masonry structure comprising a plurality of regular masonry blocks and/or bricks connected to each other by a plurality of metal bars and a plurality of standard metal threaded fasteners thereby forming a post tensioned structure. This Bolt-A-Block system is generally shown in FIG. 3. Preferably, the blocks are operatively connected to each other as a structure by simple mechanical tools. Each interconnection results in a unitized post tensioned member that, when interconnected to the adjacent members, forms a comparatively higher strength structure than systems made of mortar and reinforced mortar. The method used to create this structure is a simple, waterless, mortar less interconnection process that is completed by a series of simple individual steps of fastening the blocks and bars into a strong and durable structure. Once connected the structure is strong and durable. Important to note is that a small gap 44A occurs between the adjacent blocks 30 due to the placement of the bars 33. This separation is then filled or caulked to complete the wall surface. If desired, the structure may be disassembled and the components be re-used. This new UNITIZED POST TENSION BLOCK SYSTEM FOR MASONRY STRUCTURES provides significant improvement and changes to the Bolt-A-Blok system that are not anticipated by the Bolt-A-Blok system. The improvements locate the bar (anchors) and increase the speed of build for the mortar less system. The recessed and embedded features remove the gap and need no filling. In addition, several embodiments provide higher strength options that increase the use for defense and anti-terrorism applications.

Traditional post-tensioned units 52 may have various configurations (as shown in FIG. 4E). To date this technology has been essentially unobvious as being applied at a unitized configuration. Individual blocks are attached to each other and now, as a new combination, perform as if it were all one post-tensioned beam, bridge, wall, or structure. This UNITIZED POST TENSION BLOCK SYSTEM FOR MASONRY STRUCTURES works equally well with all sizes of concrete masonry units.

Traditional Post-Tensioned reinforcing consists of very high strength steel strands or bars. Typically, strands are used in horizontal applications like foundations, slabs, beams, and bridges; and bars are used in vertical applications like walls and columns. A typical steel strand used for post-tensioning has a tensile strength of 270,000 pounds per square inch. This actually teaches against the UNITIZED POST TENSION BLOCK SYSTEM FOR MASONRY STRUCTURES use of individual, standard bolts and simple fasteners. Post-tensioning using plates, or bars, between the masonry units is a totally new way of combining steel and concrete and is sound engineering practice.

None of the prior art teaches all the features and capabilities of the UNITIZED POST TENSION BLOCK SYSTEM FOR MASONRY STRUCTURES. As far as known, there are no systems at the present time which fully meet the need for a unitized, post-tensioned masonry block structure as well as the UNITIZED POST TENSION BLOCK SYSTEM FOR MASONRY STRUCTURES. It is believed that this system is made with component parts, is built with simple tools, needs no mortar, provides a much stronger structure than mortar structures, and is ready for immediate use and occupation upon construction.

SUMMARY OF THE INVENTION

A Unitized Post Tension Block System for Masonry STRUCTURES has been developed for use in constructing various types of masonry structures. UNITIZED POST TENSION BLOCK SYSTEM FOR MASONRY STRUCTURES is a building system that demountably couples each individual hollow cored block or brick by use of a bar and bolt system. This coupling results in stronger, faster, and cheaper construction of buildings. While the three main components—a bar, a bolt and a block—are securely connected, the means of attachment is capable of full disassembly if desired. The UNITIZED POST TENSION BLOCK SYSTEM FOR MASONRY STRUCTURES can be accomplished by unskilled persons with a simple wrench. There is no need for water, no special tools (a simple wrench will suffice), no bracing, and the structure made by the UNITIZED POST TENSION BLOCK SYSTEM FOR MASONRY STRUCTURES is ready for immediate use. The improved UNITIZED POST TENSION BLOCK SYSTEM FOR MASONRY STRUCTURES features hollow core (duct) masonry units with recessed channels or pockets or with embedded bars, with a fastener bolt (tendon) and with a plate (anchor). The new features also teach a strong and durable full plate anchor for defensive and anti-terrorism structures.

OBJECTS, ADVANTAGES AND BENEFITS

There are many, many benefits and advantages of the UNITIZED POST TENSION BLOCK SYSTEM FOR MASONRY STRUCTURES just as there were with the prior art described above. There currently exist no construction systems that use readily available parts and are so easy to perform. However, by having the unitized post tensioning technology, the structure is a far stronger unit than one built by traditional mortar-using techniques. TABLE A shows a list of advantages and benefits over the prior art Bolt-A-Block system. TABLE B shows the list of advantages and benefits SIMILAR TO Bolt-A-Block for the advantages over traditional mortar and block systems.

TABLE A

ADVANTAGES AND BENEFITS OVER A BOLT-A-BLOK SYSTEM

| ITEM | DESCRIPTION |
|---|---|
| 1 | elimination of any gap between the CMUs. No filling or caulking of the space is required. |
| 2 | precise placement of the anchor bar |
| 3 | faster build time with the recessed channels or the embedded bars |
| 4 | commercial tracking of the invention with the embedded bars |
| 5 | stronger military/defense use and anti-blast applications |
| 6 | features for easier, faster build with placement aids |
| 7 | features with anti-turn and quick connections with oval plates/washers and threaded tendons |

TABLE B

ADVANTAGES SIMILAR TO BOLT-A-BLOK

| ITEM | DESCRIPTION |
|---|---|
| 1 | Is Waterless |
| 2 | Requires no wait time to get structural strength |
| 3 | Requires no temporary support while mortar cures and gains strength |
| 4 | Uses simple hand tools |
| 5 | Is Useful with/without footer |
| 6 | Has greater final tensile and compressive strength than mortar construction - is much stronger |
| 7 | Is Environmental friendly - Uses less wood, hence there is less deforestation required to support construction |
| 8 | Has An improved total cost - material and unskilled labor |
| 9 | Permits rapid build. |
| 10 | Can be easily disassemble and components re-used. |
| 11 | Does not require skilled labor |
| 12 | Has Global/worldwide/universal applications |
| 13 | Can be built on soil or standard foundation |
| 14 | Spans greater distances between vertical double blocks |
| 15 | Is easy to learn the build concept and start building with non-skilled workers. With this easy learning curve, it is simple to learn and simple to use. So simple that multiple workers may be in the same area - not "laying" block but assembling a structure |
| 16 | Provides perfect spacing which means more attractive walls. Blocks have perfect alignment and correct placement before tightening |
| 17 | Reduces fire insurance and wind insurance costs |
| 18 | Uses existing modular sizes, worldwide. |
| 19 | Is an all weather construction. All kinds of weather, rain, snow, wind, cold, hot, underwater, even in a diving bell or caisson |
| 20 | Is a Unitized construction. If one stops or anything interrupts the build at any point, one can resume immediately without the former problems of mortar drying out and the other messy problems. |
| 21 | May build a wall by working from either side. Inside or outside. |
| 22 | Works with one or more core block, brick, and other building units |
| 23 | Requires less scaffolding, ladder jacks and walk boards because the walls are immediately at full strength. |
| 24 | Can pour concrete in cores and even add vertical rebar's. |
| 25 | Can pour insulation or spray foam in cores. |
| 26 | Resists flying debris. |
| 27 | Resists Earthquake and Hurricane/tornado. |
| 28 | Is fire resistant. |
| 29 | Is not dependent on mortar strength |
| 30 | Requires no power or gasoline to build |
| 31 | Is useable with other construction techniques—door and window frames, roof and ceiling joists and trusses; metal and asphalt/fiber/rubber roofing; |
| 32 | Is useable with standard plumbing, electrical, communications and lighting packages |

TABLE B-continued

| ADVANTAGES SIMILAR TO BOLT-A-BLOK | |
|---|---|
| ITEM | DESCRIPTION |
| 33 | Has the ability to construct several block layers at one time—speeds overall construction |
| 34 | Adapts to regular interior (plaster, boars, panel, paint) and exterior wall surfaces (siding, brick, stucco, etc) |
| 35 | Provides perfect plumb and level alignment |
| 36 | Does not require poured foundations |
| 37 | Is a Unit by unit construction |
| 38 | The simple bar and bolt is easily mass produced using existing materials and equipment. |
| 39 | Is possible for the builder to leave out a small portion of the foundation wall so that trucks and backhoes can easily cross into the structure to grade, spread stone, unload concrete or do whatever is necessary. As soon as the heavy inside work is completed, the wall is quickly bolted into place and is ready to go, at full strength. |
| 46 | Provides a mass that is so strong, and the total weight of a UNITIZED POST TENSION BLOCK SYSTEM FOR MASONRY STRUCTURES building is of such signigicant weight, that below ground freezing may largely only push sideways. |
| 47 | May be combined with a pre-constructed bath and/or kitchen unit. |
| 48 | Is termite and carpenter ant proof. |

For one skilled in the art of construction of structures, especially masonry, concrete, and steel structures, it is readily understood that the features shown in the examples with this system are readily adapted to other types of construction improvements.

DESCRIPTION OF THE DRAWINGS—FIGURES

The accompanying drawings, which are incorporated in and constitute a part of this specification, illustrate an embodiment of the UNITIZED POST TENSION BLOCK SYSTEM that is preferred. The drawings together with the summary description given above and a detailed description given below serve to explain the principles of the UNITIZED POST TENSION BLOCK SYSTEM. It is understood, however, that the UNITIZED POST TENSION BLOCK SYSTEM is not limited to only the precise arrangements and instrumentalities shown.

FIG. 1 in FIGS. 1 A and 1 B are sketches of the general UNITIZED POST TENSION BLOCK SYSTEM.

FIG. 1 in FIGS. 1 C and 1 D are sketches of the general UNITIZED POST TENSION BLOCK SYSTEM with specific features and components identified.

Figures 2, 2A, 2B, 2C:
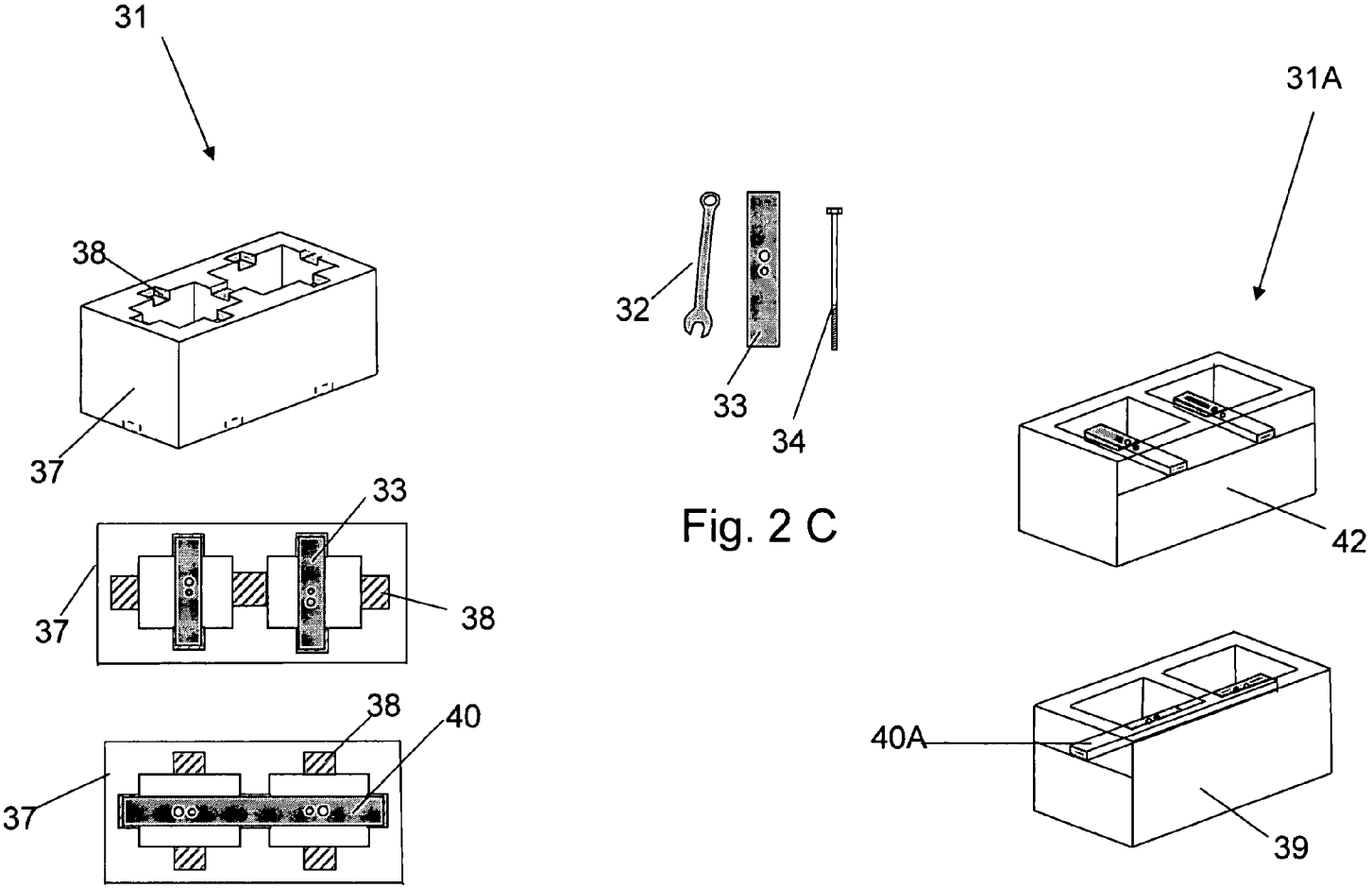

FIGS. 2 A through 2 C are sketches of general details and components of the UNITIZED POST Tension Block System FIG. 3 are sketches of prior art for the Bolt-A-Blok system (BABS) which utilizes standard masonry units and external bar and bolt system to establish a post tensioning system.

FIGS. 4 A through 4 E are additional prior art depictions.

FIGS. 5 A to 5 C are sketches of other prior art.

Figure 6:
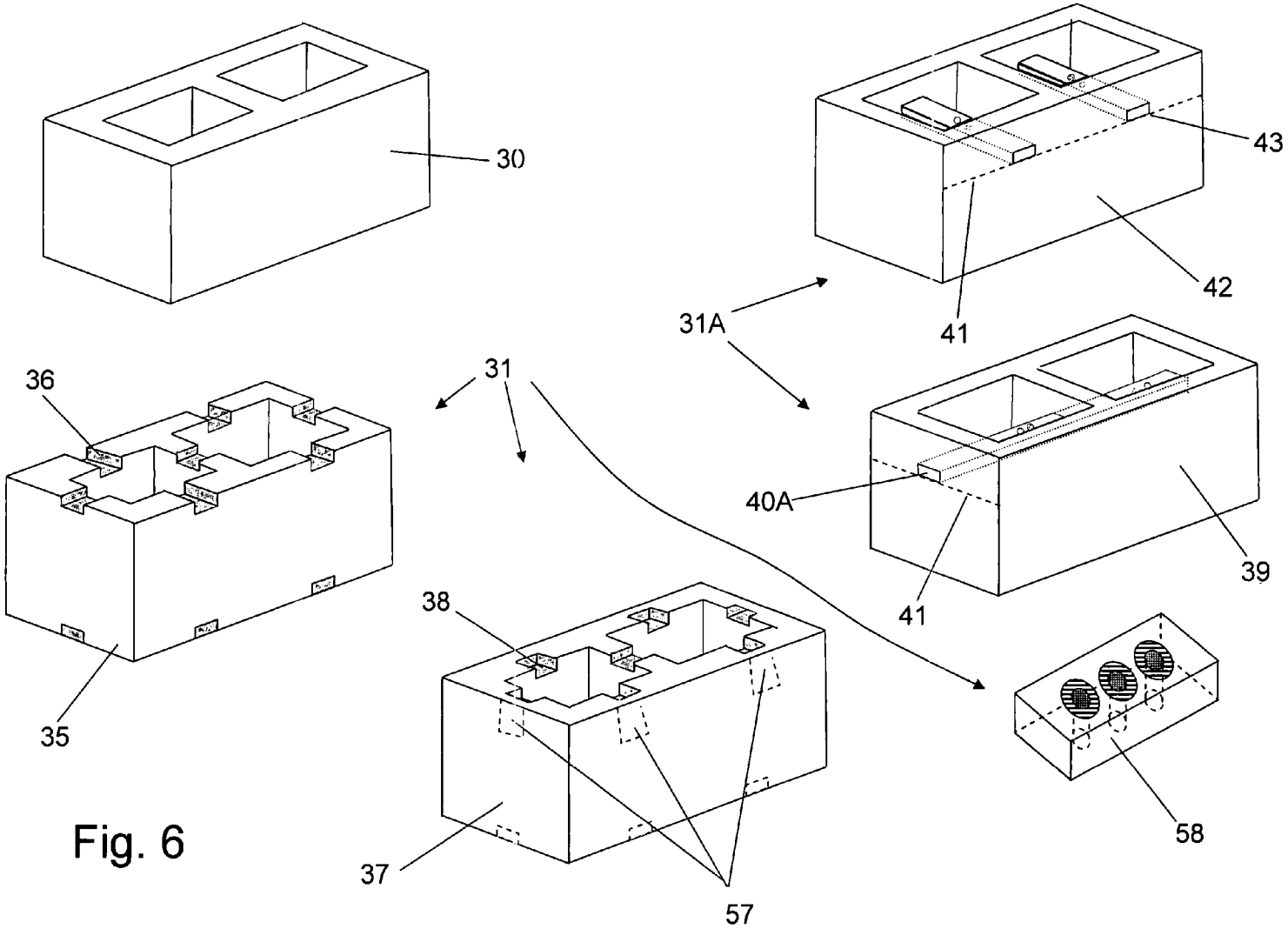

FIG. 6 depicts recessed channels, pockets, and embedded bar options.

Figures 7, 7A, 7B, 7C:
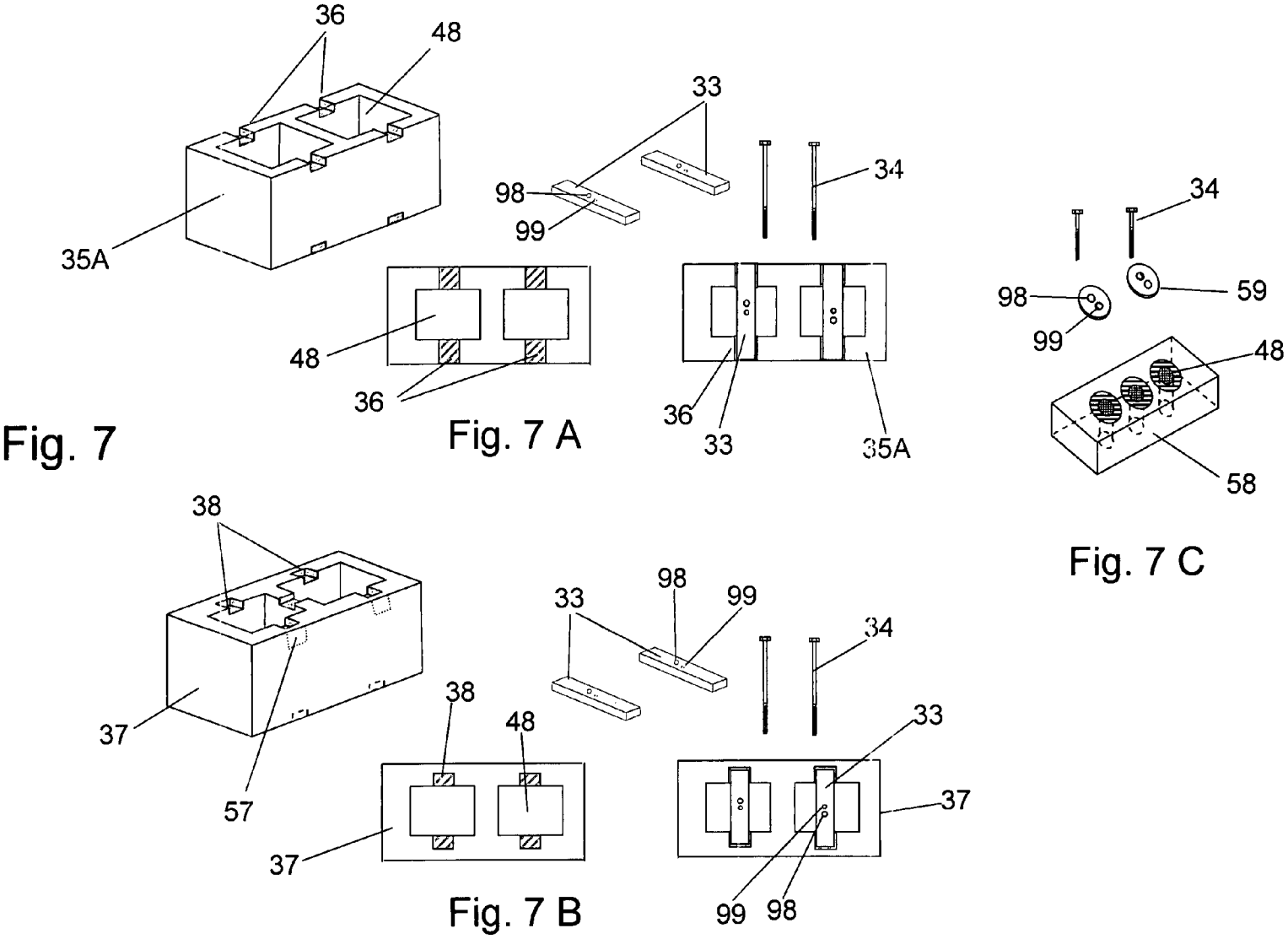

FIGS. 7 A through 7 C show the details of the UNITIZED POST TENSION BLOCK SYSTEM for lateral recessed channels in CMUs.

Figures 8, 8A, 8B:
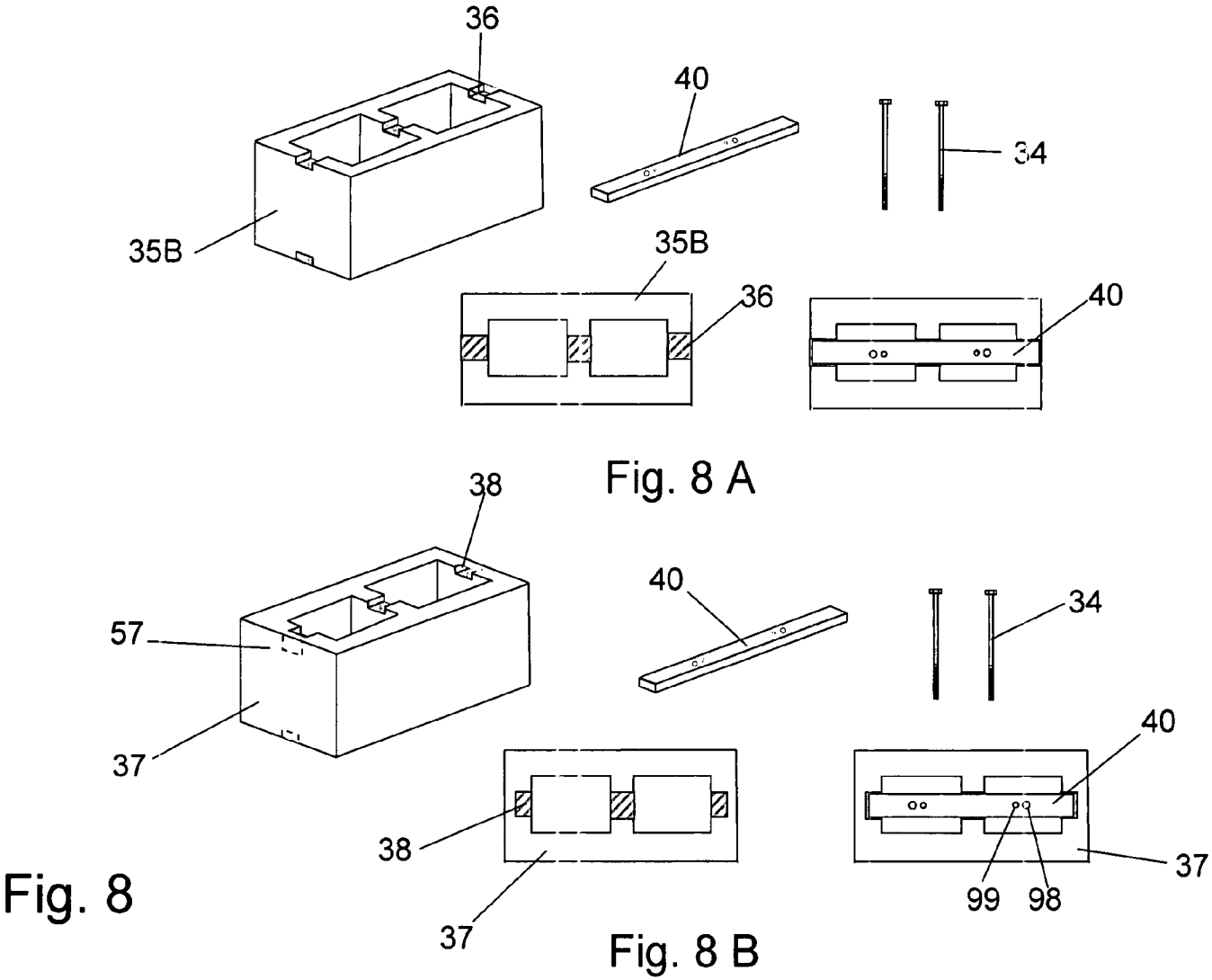

FIGS. 8 A and 8 B are CMUs with longitudinal bar systems for recessed channels.

Figure 9:
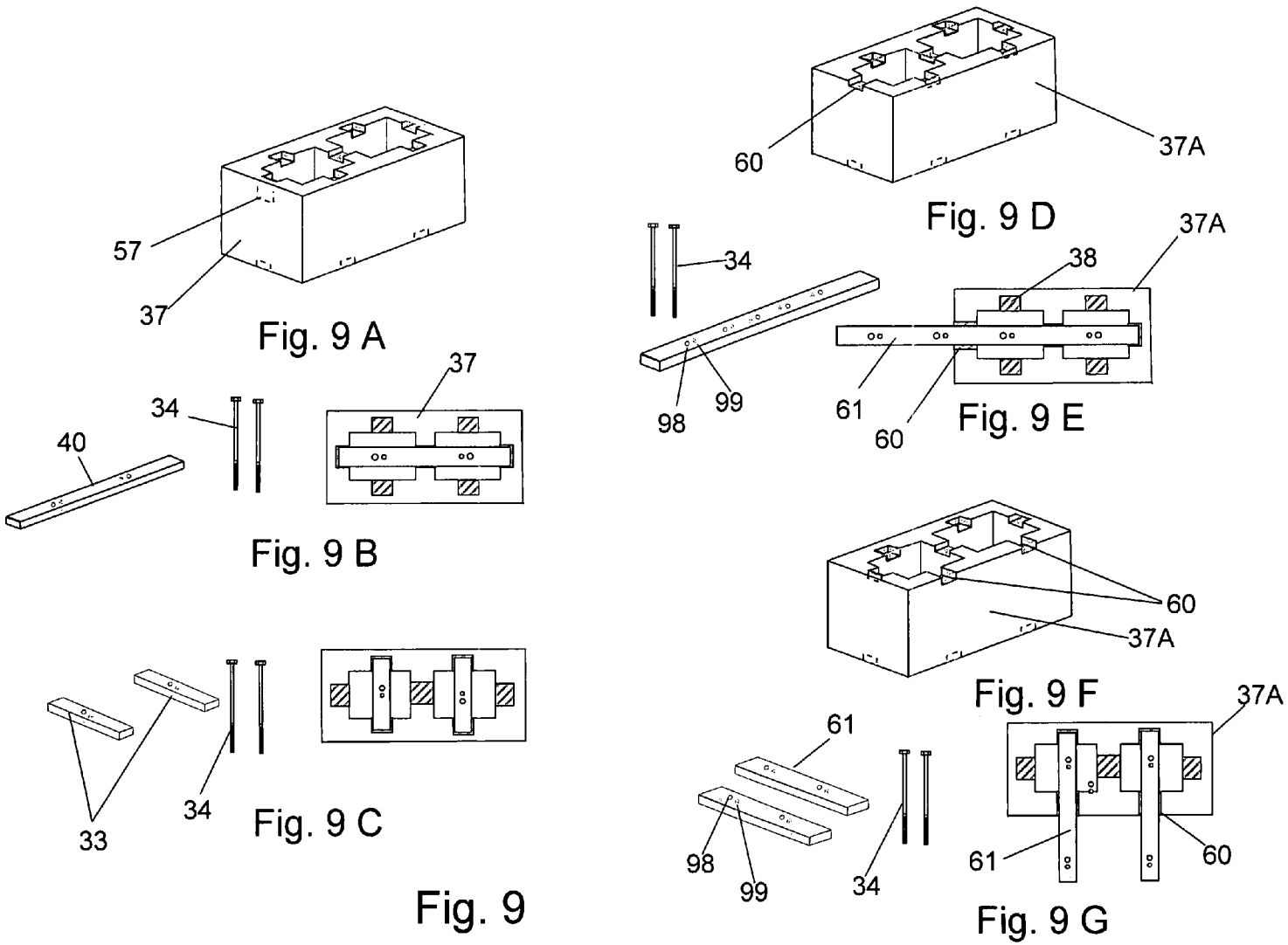

FIGS. 9 A through 9 G show sketches of CMUs with pocket recessed block systems for a UNITIZED POST TENSION BLOCK SYSTEM.

Figure 10A:
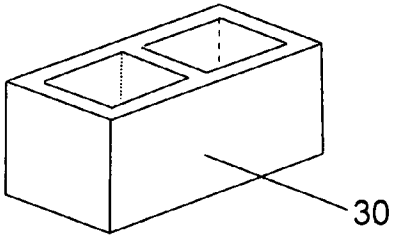
Figure 10B:
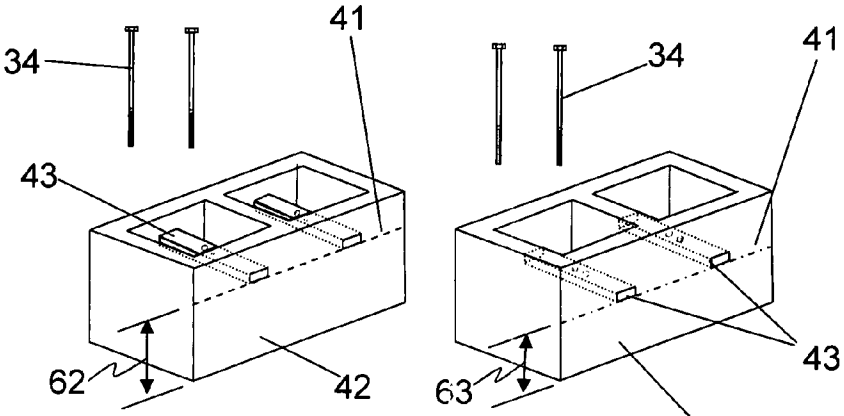
Figure 10C:
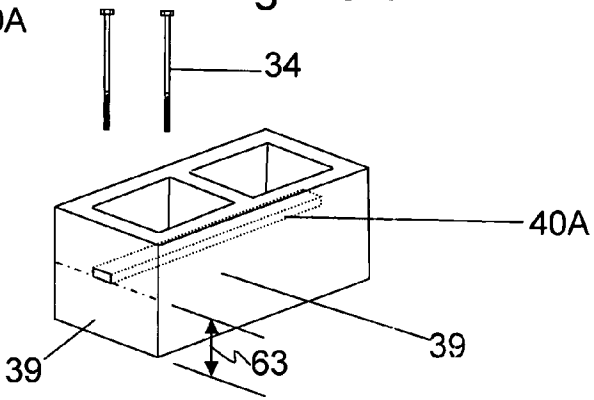
Figure 10:
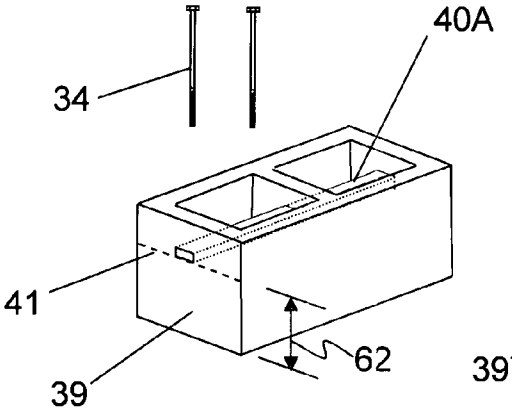

FIGS. 10 A through 10 C provide sketches of CMUs with the embedded bar options for the UNITIZED POST TENSION BLOCK SYSTEM.

Figure 11A:
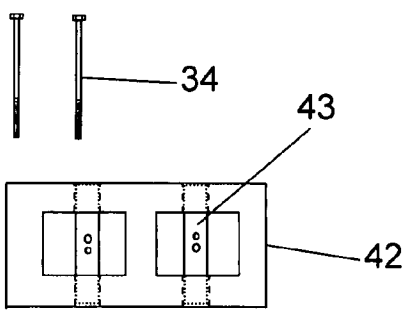
Figure 11A:
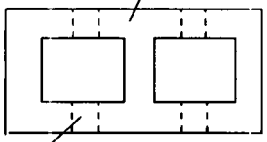
Figure 11B:
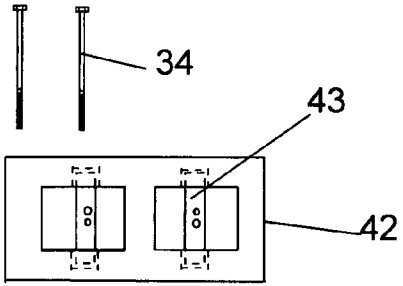
Figure 11B:
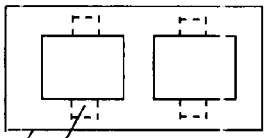
Figure 11:
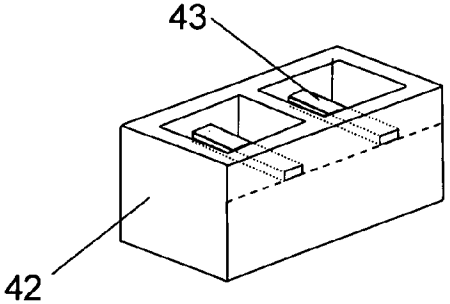
Figure 11:
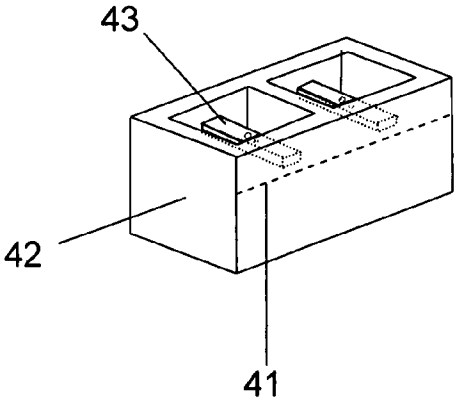

FIGS. 11 A and 11 B show sketches of CMUs with a lateral embedded bar system.

Figure 12A:
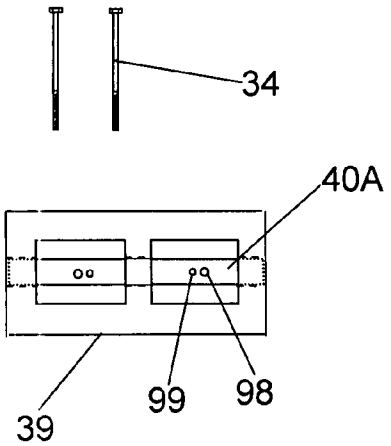
Figure 12A:
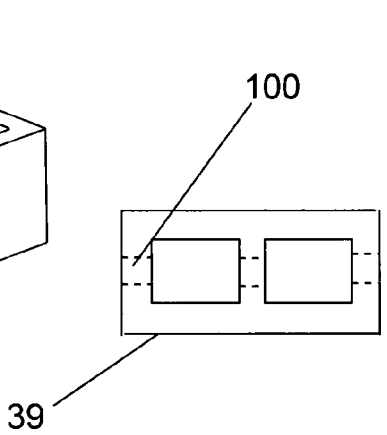
Figure 12B:
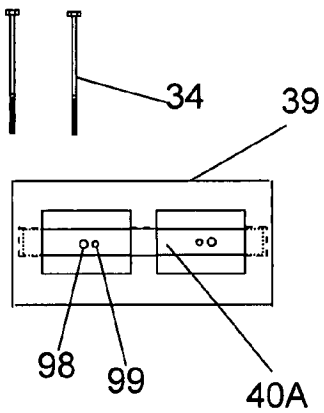
Figure 12B:
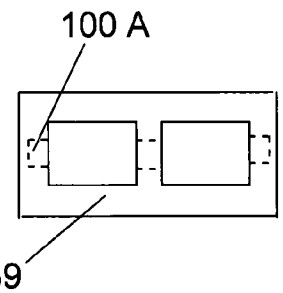
Figure 12:
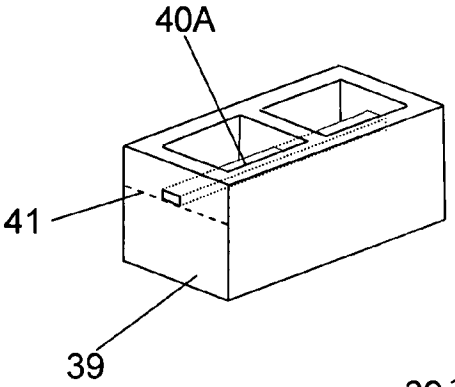
Figure 12:
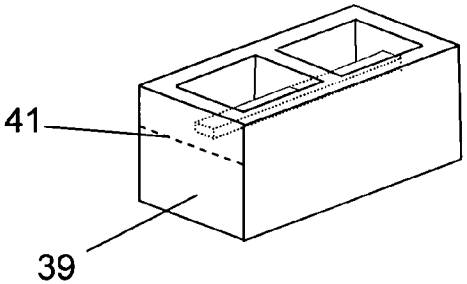

FIGS. 12 A and 12 B show sketches of CMUs with a longitudinal embedded bar system.

Figures 13, 13A, 13B, 13C, 13D, 13E, 13F:
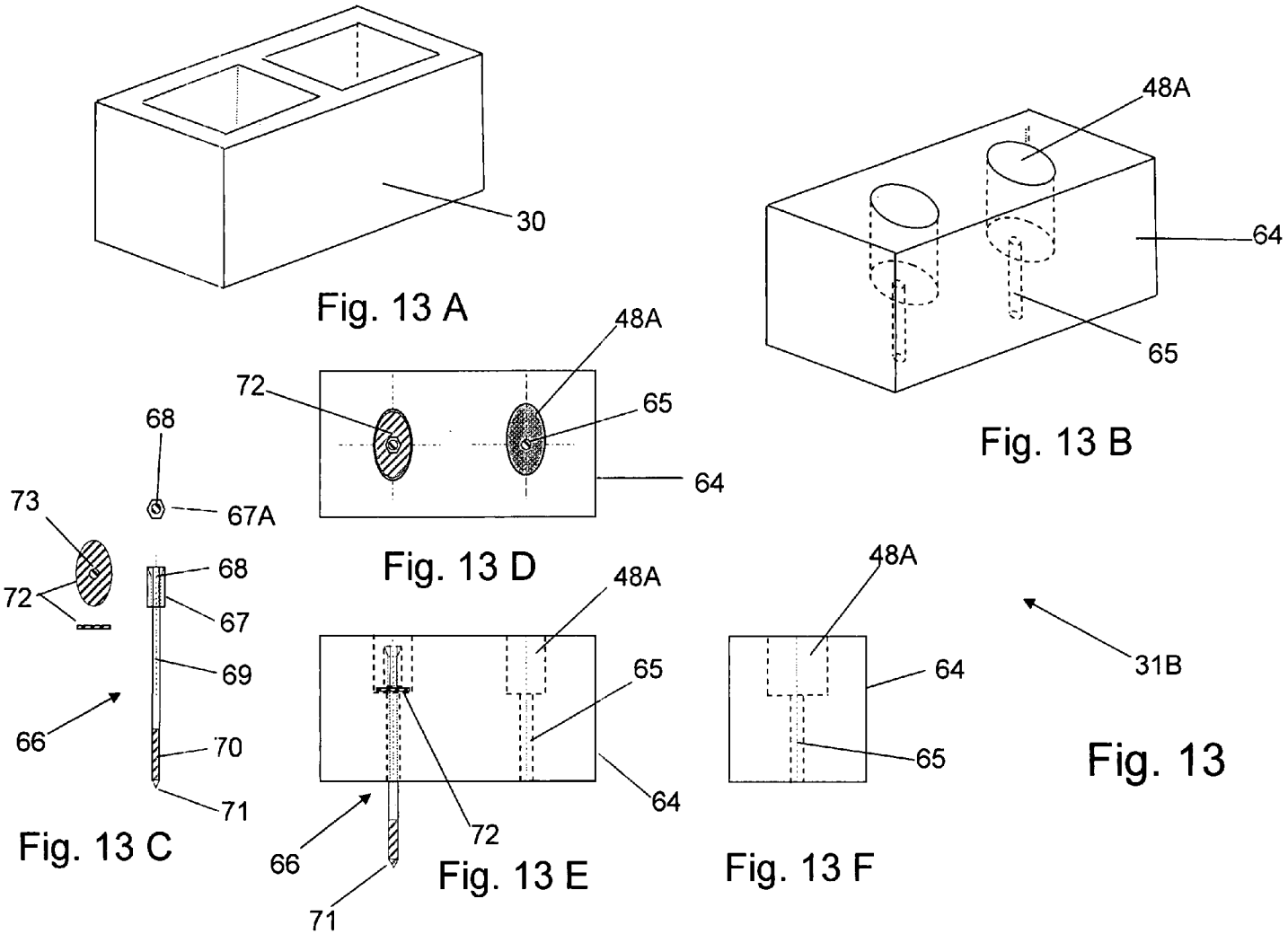

FIGS. 13 A through 13 F show sketches of a CMU with special recessed pockets in the blocks used with the UNITIZED POST TENSION BLOCK SYSTEM.

FIGS. 14 A through 14 F show sketches of optional features and typical uses of the UNITIZED POST TENSION BLOCK SYSTEM.

Figure 15:
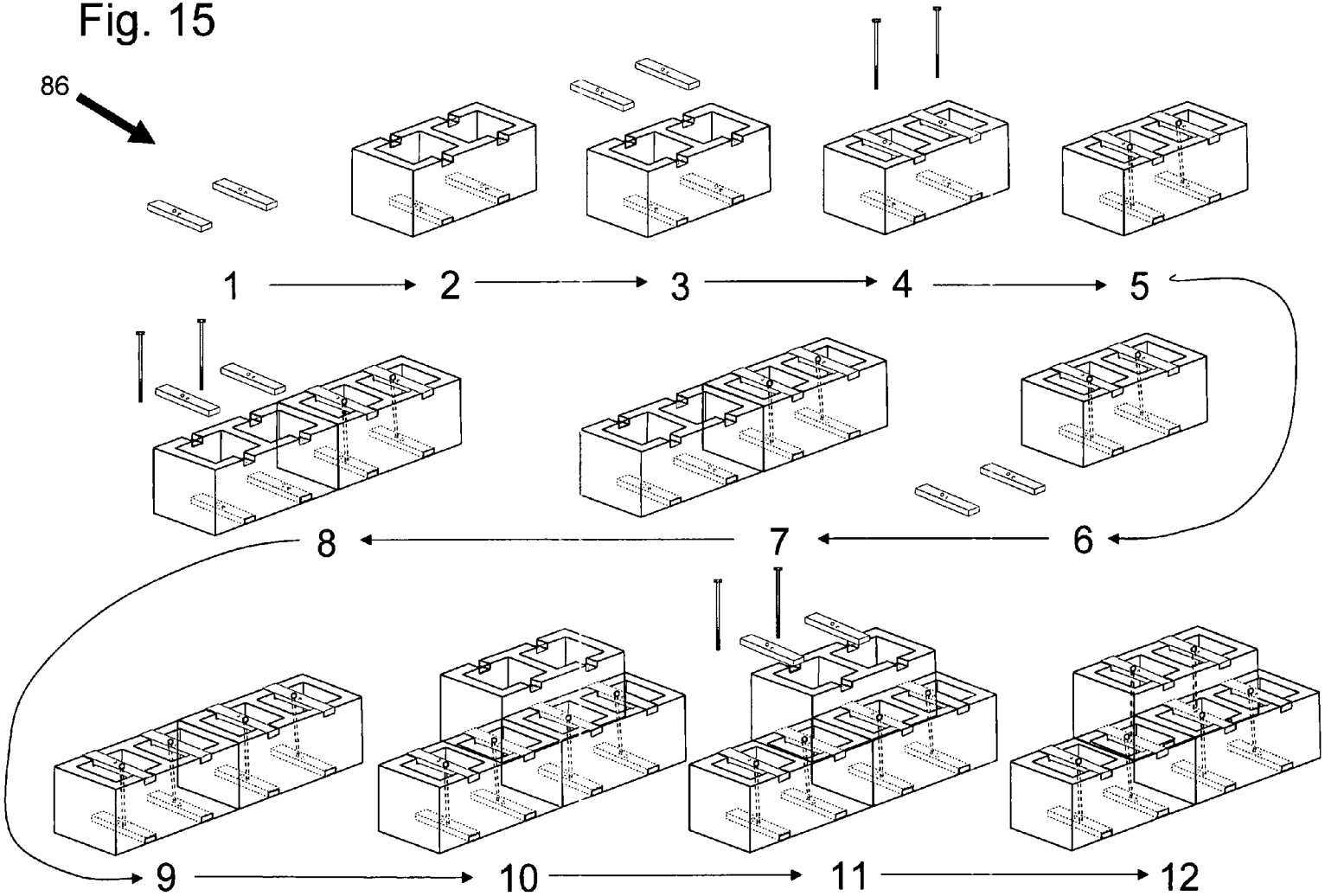

FIG. 15 shows the process of assembly for a UNITIZED POST TENSION BLOCK SYSTEM, including steps 1 through 12, for a CMU with recessed pockets.

FIGS. 16 A and 16 B show sketches of a heavy duty option for the UNITIZED POST TENSION BLOCK SYSTEM for use in defensive and anti-terrorism Applications.

Figure 17:
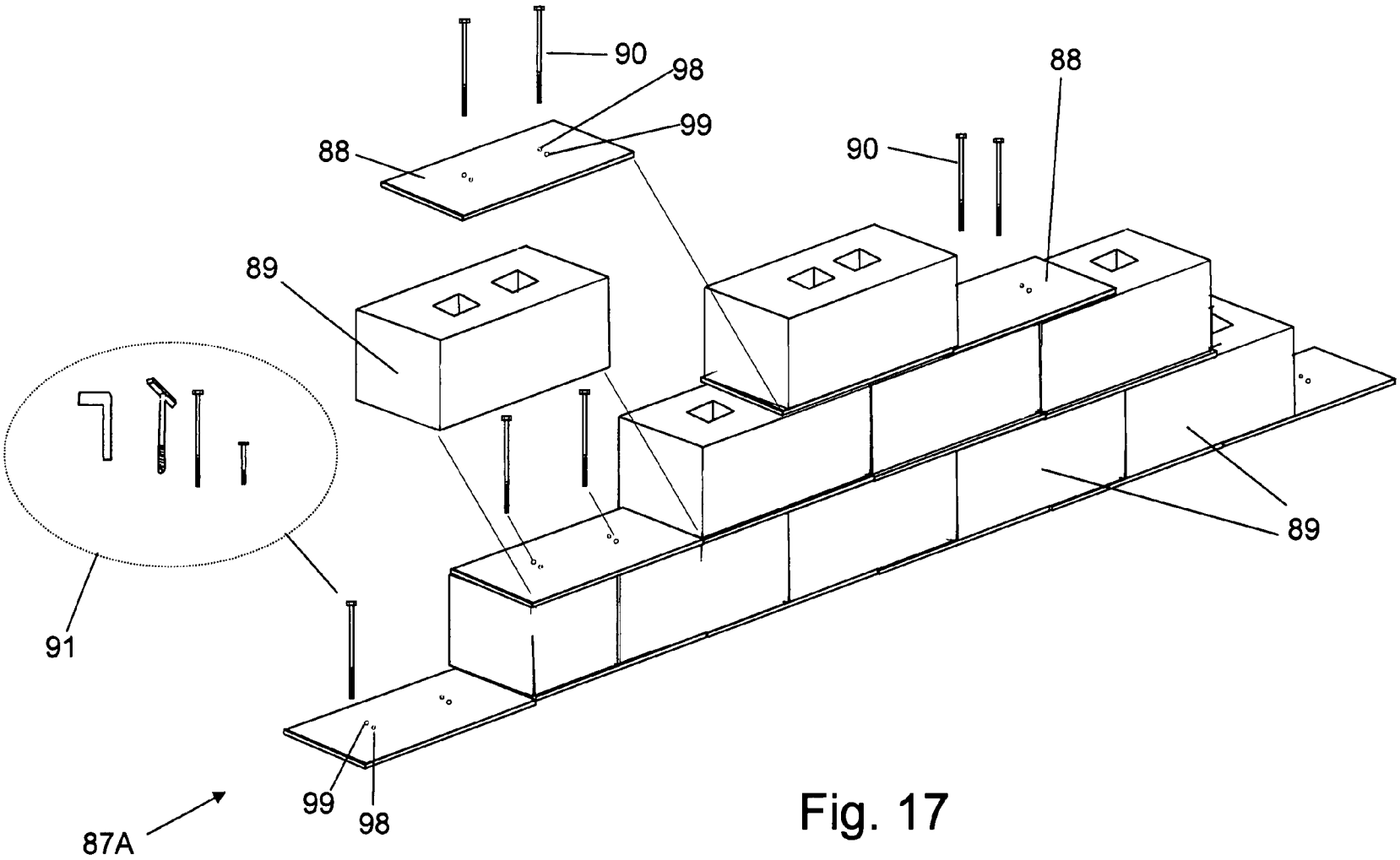

FIG. 17 shows an application for the heavy duty application.

FIGS. 18 A through 18 E show sketches of applications for the heavy duty option of the UNITIZED POST TENSION BLOCK SYSTEM.

DESCRIPTION OF THE DRAWINGS—REFERENCE NUMERALS

The following list refers to the drawings:

30 typical concrete masonry unit—CMU
31 general parts for assembly of the UNITIZED POST TENSION BLOCK SYSTEM—recessed bar positioner channel
31A general parts for assembly of the UNITIZED POST TENSION BLOCK SYSTEM—embedded bar
31B general parts for assembly of the UNITIZED POST TENSION BLOCK SYSTEM—special oval recess
32 wrench
33 anchor for post tensioning such as a bar with connection features
34 tendon for post tensioning such as a bolt
35 concrete masonry unit with recess channels
35A concrete masonry unit with lateral only recess channels
35B concrete masonry unit with longitudinal only recess channels
36 extended recess channels
37 concrete masonry unit with pocket recesses
37A concrete masonry unit with some of the pocket recesses "knocked out" to an open channel
38 pocket recesses
39 concrete masonry unit with embedded longitudinal anchor (bar)
40 longitudinal anchor for post tensioning (bar)
40A embedded longitudinal anchor (bar) for post tensioning
41 position of bar embedment
42 concrete masonry unit with embedded lateral anchor (bar)
43 embedded lateral anchor (bar) for post tensioning
43A partially 43 embedded lateral anchor (bar) for post tensioning
44 point of contact (touching) for contiguous CMUs
44A space between adjacent block (in prior art
45 starter fastener to anchor starter bars or plates
46 base means device (foundation, board, plate, etc.)
47 prior art Bolt-A-Blok method for mortar less assembly of typical CMUs.
48 hollow cavity in a CMU
48A deep recesses of hollow cavity in a special CMU

49 prior art special block and through rods
50 typical mortar and block wall section
51 prior art rebar in block system
52 prior art post tension cables in concrete
53 rod—partially or fully threaded
54 rod connector
55 prior art of pre-cast modular spar system
56 prior art of mechanically stackable block configuration
57 knockout feature
58 small CMU such as a brick or the like
59 oval/elliptical anchors for post tensioning
60 open knockout to provide recessed channel
61 extender bar
62 offset (high or low) embedded bar position
63 midway embedded bar position
64 special block with recessed cavities for ovular/elliptical anchors for post tensioning
65 CMU aperture for tendon
66 special tendon for unitized post tensioning
67 means to turn tendon (66) such as a hex or the like
67A top view of means to turn tendon (66)
68 threaded aperture
69 extension of special tendon (66)—shaft or equal
70 threaded end of special tendon (66)
71 tapered/chamfered end of special tendon (66)
72 ovular/elliptical shaped spacer
73 aperture in ovular spacer (73)
74 extra wide CMU
75 ledge
76 sloped means to locate aperture in anchor plate for tendon
76A alternative sloped means to locate aperture in anchor plate for tendon
77 aperture
78 means to attach (adhesive, sticky surface, or equal)
79 original footer trough
80 compacted back fill, concrete, or equal
81 skeleton of unitized post tensioning tendons and anchors
82 special CMU block with a configuration to deter moisture penetration between CMUs
83 configuration to deter moisture penetration between CMUs
84 tapered labyrinth configuration
85 right angle/squared labyrinth configuration
86 assembly process for UNITIZED POST TENSION BLOCK SYSTEM with re-usable components
87 general parts for high strength (military defense or anti-terrorism) configuration of the UNITIZED POST TENSION BLOCK SYSTEM
87A assembly of the high strength (military defense or anti-terrorism) configuration of the UNITIZED POST TENSION BLOCK SYSTEM
88 full coverage CMU surface plate anchor for post tensioning
89 high density CMU with relatively small cavity
90 high strength tendons such as #5 or #8 grade steel or equal
91 miscellaneous anchors for attachment to foundation or mounted structure
92 lateral deck or bridge
93 deck or bridge support
94 deck load such as humans, equipment or material
95 vehicle (military or other)
96 bed or support structure of vehicle
97 blast proof bed cover
98 through hole aperture in anchor (bar) for post tensioning
99 threaded hole aperture in anchor (bar) for post Tensioning
100 contact area/aperture for full width embedded anchor (bar) in CMU
100A contact area/aperture for partial width embedded anchor (bar) in CMU

DETAILED DESCRIPTION OF PREFERRED EMBODIMENT

The present invention is a construction system called a UNITIZED POST TENSION BLOCK SYSTEM FOR MASONRY STRUCTURES 31. This post tensioning system is comprised of only a few different types of components—a hollow core block 35 (and others) in which the hollow cavity 48 is the duct, a series of tendons (such as a through bolt) 34, and a plurality of simple anchors (such as a bar) 33 with some additional features. The system is configured with the plurality of adjacent blocks 35 contiguous and touching one another and demountably coupled to each other by means of the tendons 34 and anchors 33. This coupling results in a structure that is formed from a plurality of unitized, post tensioned concrete masonry units (usually called blocks or bricks) that collectively are far stronger than an ordinary block structure built with mortar and standard reinforcing. A person having ordinary skill in the field of construction, especially with reinforced masonry structures, appreciates the various parts that may be used to physically permit this UNITIZED POST TENSION BLOCK SYSTEM FOR MASONRY STRUCTURES 31 to be produced and utilized. The improvement over the existing art is providing a construction system that has many advantages and benefits as stated in the previous section entitled Objects, Advantages, and Benefits. The advantage over the newer Bolt-A-Blok includes precise placement of the anchor bar, faster build time with the recessed channels or the embedded bars, commercial tracking of the invention with the embedded bars, stronger military/defense use and anti-blast applications, features for easier, faster build with placement aids, and features with anti-turn and quick connections with oval plates/washers and threaded tendons.

There is shown in FIGS. 1 and 2, in FIGS. 6 through 14 and FIG. 16 a complete operative embodiment of the UNITIZED POST TENSION BLOCK SYSTEM FOR MASONRY STRUCTURES 31 and alternative embodiments. In the drawings and illustrations, one notes well that drawings and sketches demonstrate the general configuration of this invention. The preferred embodiment of the system is comprised of only a few parts as shown. Various important features of these components are also delineated and are described below in appropriate detail for one skilled in the art to appreciate their importance and functionality to the UNITIZED POST TENSION BLOCK SYSTEM FOR MASONRY STRUCTURES 31.

The accompanying drawings, which are incorporated in and constitute a part of this specification, illustrate embodiments of the UNITIZED POST TENSION BLOCK SYSTEM FOR MASONRY STRUCTURES 31 that are preferred. The drawings together with the summary description given above and a detailed description given below serve to explain the principles of the UNITIZED POST TENSION BLOCK SYSTEM FOR MASONRY STRUCTURES 31. It is understood, however, that the UNITIZED POST TENSION BLOCK SYSTEM FOR MASONRY STRUCTURES 31 is not limited to only the precise arrangements and instrumentalities shown.

FIGS. 1 A and 1 B are sketches of the general UNITIZED POST TENSION BLOCK SYSTEM FOR MASONRY STRUCTURES 31 and 31 A. In the FIG. 1 A, an embodiment for a recessed channel for a bar embodiment is shown and in FIG. 1 B an embedded bar option is depicted.

In FIGS. 1 C and 1 D are sketches of the general UNITIZED POST TENSION BLOCK SYSTEM 31 and 31A with specific features and components identified. The UNITIZED POST TENSION BLOCK SYSTEM 31 shown in FIG. 1A with components and features described in FIG. 1 C is the preferred embodiment. Other configurations shown and described below are alternative embodiments. Here a concrete masonry unit 37 with pocket recesses 38 is shown stacked together as a general configuration 31. The pocket recesses 38 are show in which the bars 33 may be placed. Each CMU block 37 is touching the adjacent block as denoted by the "closed" point of contact 44. This is a very distinct improvement to prior art for speed of assembly and for elimination of a gap between the CMUs. Obviously, the bars 33 and the bolts 34 may be manufactured from may types of materials including, but not limited to metal (such as steel, stainless steel, titanium, brass, aluminum and the like); from composite materials (including plastics and reinforced plastics; reinforced resin based materials, and the like); and from other materials suitable to create tendons and anchors for a post tensioning system. The stack 31 is mounted onto the base means 46 by an anchor 45. Likewise, the other embodiment with embedded bars 31A is shown. The bars 33 are manufactured into the concrete masonry unit 42. The bolt/tendons 34 join each anchor/bar 33 individually. The entire stack 31A is mounted on the base means 46 by the base anchor 45.

FIGS. 2 A through 2 C are sketches of further general details and components of the UNITIZED POST TENSION BLOCK SYSTEM 31. In FIG. 2 A, a recessed pocket 37 is shown. The Pockets 38 are configured into the uppermost surface of the CMU to allow for the bars 33 to be placed. These bars may be lateral 33 or longitudinal 40. Preferably, the recessed pockets 38 are manufactured into the CMUs as the blocks themselves are manufactured. As an alternative, the recesses may be cut or ground into standard blocks if desired in a secondary operation. This secondary operation may be at a manufacturing location or at the jobsite where the structure is being built. The recesses are nominally the same size as the bars with, of course, some additional clearance to permit the bars 33,40 to easily slip fit within the pocket 38 and yet be uniformly located. This clearance may be empirically determined with several thousandths of an inch clearance anticipated for easy build. No specific dimension is provided so as to purposefully not limit the scope and spirit of the invention. In FIG. 2 B, optional CMU 31A has the embedded bar CMU 42 is drawn showing the bars 40A manufactured within the CMU. In FIG. 2 C the bar 33, the bolt 34 and the wrench 32 are depicted.

One should note that FIGS. 3 through 5 are sketches of prior art for masonry and post tensioned structures. These are discussed in the prior art section above. However, a knowledge of those prior configurations and building methods serve an important background for one skilled in the art to fully appreciate the unique characteristics provided by the UNITIZED POST TENSION BLOCK SYSTEM FOR MASONRY STRUCTURES 31. For many decades, and in fact more than a full century, masons and builders, architects and engineers, have had hollow masonry blocks and bricks to use. Likewise, steel bars and various fasteners have been readily available. However, no one taught or developed this unique, simple combination as an obvious extension of the construction technology.

FIG. 6 depicts recessed channels, pockets, and embedded bar options. The typical CMU 30 is shown as a reference. A CMU with recessed channels 35 is shown. The channels 36 may be laterally or longitudinally configured and traverse the full width of the wall. Another embodiment of the CMU is a CMU with pockets 37. These pockets 37 are only on the interior of the CMU. The CMU has a "knock-out" feature 57 on the exterior of the CMU. When or if a bar is needed to extend past the exterior surface of the CMU, the knockout 57 is merely removed by knocking the sidewall out of the block. Further details are described below. Other embodiments shown are the CMUs with embedded bars 39 and 42. Here the lateral bar 43 is embedded into the CMU 42 at a certain position 41. Likewise for a longitudinal bar 40A, it is embedded into an embedded CMU 39 at a certain position 41. Finally, a small CMU 58 such as a brick is depicted with hollow cavities to serve as ducts for the post tensioning system.

FIGS. 7 A through 7 C show the details of the UNITIZED POST TENSION BLOCK SYSTEM 31 for CMUs with lateral recessed channels. In FIG. 7 A is depicted one of the types that feature a CMU 35A with a full recessed channel 36. This extended channel 36 permits the bars 33 to run the full width of the CMU 35A. The recessed channels 36 extend across the hollow core 48 of the CMU 35A. Other features indicated are the through hole 98 with a clear aperture through the bar 33 and the threaded hole 99 which has an internal thread to connect with the through bolts 34. Another configuration for receiving the lateral bars 33 is shown in FIG. 7 B. Here the CMU 37 has pocket recess 38. In this CMU 37, the bars 33 only extend part of the width across the CMU 37. This contains the bar 33 from extending to the edge of the CMU 37. One skilled in the art understands that the bars 33 may be more rapidly placed in the pocket recesses 38. Important to the aesthetics of the sides of the CMU 37 is the lack of any bar protruding to the CMU edges like the CMU 35A described above. These pocket recesses do have a scored knockout feature 57 which permits one to remove (i.e. "knock or cut out") the side section and permit extended bars to be places. This feature is described below. In FIG. 7 C, a smaller CMU 58 is shown. This might be a CMU often described as a brick. In this configuration, smaller bars or oval anchors 59 are depicted. These oval anchors 59 still have the through hole 98 and threaded hole 99 for connecting the tendons 34 to the oval anchor 59.

FIGS. 8 A and 8 B show the details of the UNITIZED POST TENSION BLOCK SYSTEM 31 for CMUs with extended recessed channels 36 in a longitudinal configuration. In FIG. 8 A is depicted one of the types that feature a CMU 35B with a full recessed channel 36. This extended channel 36 permits the longitudinal bars 40 to run the full length of the CMU 35B. The recessed channels 36 extend across all of the hollow cores 48 of the CMU 35B. Another configuration for receiving the lateral bars 33 is shown in FIG. 8 B. Here the CMU 37 has pocket recess 38. In this CMU 37, the bars 33 only extend longitudinally and only part of the length along the CMU 37. This contains the bar 40 from extending to the edge of the CMU 37. Other features indicated are the through hole 98 with a clear aperture through the bar 40 and the threaded hole 99 which has an internal thread to connect with the through bolts 34. One skilled in the art understands that the bars 33 may be more rapidly placed in the pocket recesses 38. Important to the aesthetics of the sides of the CMU 37 is the lack of any bar protruding to the CMU edges like the CMU 35B described above. These pocket recesses for the longitudinal bar 40 do have a scored knockout feature 57 which permits one to remove (i.e. "knock or cut out") the side section and permit extended bars to be places. This knockout feature is described below.

FIGS. 9 A through 9 G show other sketches of CMUs with pocket recessed block systems 37 in both directions.

FIG. 9 A shows the CMU (block) with pockets 37 and the knockout feature 57. FIG. 9 B shows the CMU with recessed pockets 37 with a longitudinal bar 40 in place. FIG. 9 C shows the same type CMU with recessed pockets 37 which has two lateral bars 33 in place. In FIG. 9 D, the knockout feature 57 had been removed and results in an open knockout 60 in the CMU 37A (with the open knockout). This results in a through channel in which an extended bar 61 may be placed. This configuration of the extended bar 61 through the open knockout 60 is shown in FIG. 9 E. In FIGS. 9 F and G the similar knockout feature 60 is shown with the extended bars 61 in the lateral position. These knockout features 60 may be manufactured at the block manufacturing site, a secondary site or at the job site. These may be created by an impact to the scored knockout 57 or by cutting or grinding a standard CMU 30 to form an extended channel 36.

FIGS. 10 A through 10 C provide sketches of the embedded bar options for the UNITIZED POST TENSION BLOCK SYSTEM 31A. Here, the CMUs have embedded lateral bars 43 and longitudinal bars 40A. FIG. 10 A shows a standard CMU 30 for reference. In FIG. 10 B, Lateral embedded bars 43 are shown in the CMU 42. One skilled in the art of construction engineering understands the ability to embed the bars 43 at a certain location 41. This location 41 may vary from approximately midway 63 in the CMU or may be closer to one surface with a greater distance 62 from the opposite surface of the CMU. FIG. 10 C depicts the same distance options 62, 63 offered on the longitudinally positioned embedded bars 40A. These CMUs 39 show the longitudinal bars 40A in place. One skilled in construction techniques well appreciates that embedded bars at different distances 62,63 may have assembly advantages when the bar is closer 62 to the top surface and the UNITIZED POST TENSION BLOCK SYSTEM 31A should have more uniform strength when the bar 40A is at the midway 63 position.

FIGS. 11 A and 11 B show more sketches of a CMU 42 with lateral embedded bars 43. FIG. 11 A shows the embedded lateral bar 43 extending the full width of the CMU 42. This extension is within the contact aperture 100 that extends through the sidewalls of the CMU 42. In FIG. 11 B, the embedded lateral bar 43 extends only part-way through the sidewalls as depicted by the partial contact aperture 100A. One may note the location 41 of the embedment can vary as described above in FIG. 10.

FIGS. 12 A and 12 B show additional sketches of a CMU 39 longitudinal embedded bar 40A. FIG. 12 A shows the embedded longitudinal bar 40A extending the full length of the CMU 39. This extension is within the contact aperture 100 that extends through the sidewalls of the CMU 39. In FIG. 12 B, the embedded longitudinal bar 40A extends only part-way through the sidewalls as depicted by the partial contact aperture 100A. One may again note that the location 41 of the embedment can vary as described above in FIG. 10.

FIGS. 13 A through 13 F show sketches of a CMU 64 special recessed pocket 48A in the blocks used with the special UNITIZED POST TENSION BLOCK SYSTEM 31B. The sketch in FIG. 13 A shows a standard CMU 30 for reference. Sketches in FIG. 13 B depict the special CMU 64 with the special deep recesses 48A. The aperture 65 for the tendon is shown in this CMU 64. FIG. 13 C shows some of the other parts for this special UNITIZED POST TENSION BLOCK SYSTEM 31B. Included are the special tendon 66 which has threads 70 and a taper 71 at one end. An extension or shaft section 68 essentially creates the tendon 69 by integrally joining the ends. At the opposite end the special tendon 66 has a means to turn the tendon 67. Internal to the means to turn 67 is an aperture 68 with threads to receive the other tendons. In the same FIG. 13 C is a top view of the means 67A which also depicts the internal threaded aperture 68. An ovular shaped spacer 72 with a clear, non-threaded aperture 73 completes the components for the special UNITIZED POST TENSION BLOCK SYSTEM 31B. A sketches in FIG. 13 D depicts a top view of the special CMU 64 that shows the ovular spacer 72. Because of the oval configuration, the space 72 will not turn when placed interior to the special recess 48A. In FIG. 13 E, the oval spacer 72 is shown in place lying at the bottom of the special recess 48A. This spacer 72 provides a surface for which the tendon 66 may easily be turned and tightened by the means 67. One skilled in the art of post tensioning appreciates that the tendon 66 resting on the spacer 72 creates a unitized combination as described throughout the rest of the invention. FIG. 13 F shows an end view of the special CMU 64 with its various features.

FIGS. 14 A through 14 F show sketches of typical features and uses of the UNITIZED POST TENSION BLOCK SYSTEM 31. In FIG. 14 A, a typical wall is built with CMUs 30. A wider version CMU 74 is placed in the stack-up. This wider set of CMUs effectively create a ledge 75. This ledge 75 permit construction of floor slabs or placement of other structures such as a floor or roof joist along the ledge 75. One skilled in the art of construction with various sized CMUs recognizes that this wider block 74 and ledge 75 configuration may be easily adapted to all the various types of CMUs utilized with the UNITIZED POST TENSION BLOCK SYSTEM 31. In the sketch shown in FIG. 14 B, a wider block 74 is placed at the base of a stack of CMUs 30 to depict a wall. In this sketch an original footer location is created by digging a trough 79. The wider block 74 is placed and leveled in the trough 79. The other CMUs used in the UNITIZED POST TENSION BLOCK SYSTEM 31 are then attached and a vertical structure is constructed. A compacted fill or other aggregate 80 may then be placed to create a strong structure. One skilled in construction appreciates this configuration may provide a strong and durable foundation without the need of any concrete.

In FIG. 14 C, other features to aid with the UNITIZED POST TENSION BLOCK SYSTEM 31 are shown. Here a sloped means 76, 76A to locate the ends of the bolts or tendons 34 (not shown) with the anchor bar 33 is provided. The means 76,76A to locate may be integrally manufactured into the anchor bars 33 or may be separately manufactured and attached to the bars 33 by some means to attach 78 such as an adhesive, sticky surface or the like. In FIG. 14 D is a sketch of the skeleton 81 of unitized post tensioning tendons and anchors. This view has no CMUs shown. However, the configuration and interconnections between the tendons 34 and variously sized anchor bars 33, 40, 61 used to create the UNITIZED POST TENSION BLOCK SYSTEM 31 are depicted. This skeleton of anchors and tendons (which are located interior to the hollow cavities 48 of the CMUs) are the main key to the theory of strength of the UNITIZED POST TENSION BLOCK SYSTEM 31.

In the FIGS. E and F are sketches of special configurations to aid in preventing moisture intrusion with blocks. In a mortar less system, gaps may permit some water seepage through the gap, even if the gap is miniscule. FIG. 14 E shows a special CMU block 82 with a configuration 83 to deter moisture penetration between CMUs. The configuration may be of various shapes and designs. Two such configurations 83 are shown in FIG. 14 F. Here a tapered labyrinth configuration 84 and a right angle/squared labyrinth configuration 85 are presented. One skilled in labyrinth design appreciates these are not limitations but mere examples of the plethora of designs that may accomplish the same scope within the spirit of these designs.

FIGS. 16 A and 16 B show sketches of a heavy duty option for the UNITIZED POST TENSION BLOCK SYSTEM 87 for use with defensive and anti-terrorism applications. The overall CMU 89 is still connected to anchors and tendons through the hollow cavities. However, the defensive CMU 89 has thicker walls which result in a smaller cavities 48. The tendons 90 may be standard grade (No. 2) through bolts or higher strength (No. 5 or No. 8) in order to provide greater post tensioning capability. The anchors 88 are full plates. This eliminates any gap as shown in the Bolt-A-Blok prior art. These plates 88 are conveniently made of high strength metal such as steel (high strength alloy, standard grade, stainless, or the like) or a high strength composite material. The plates 88 may be surface finished, coated or uncoated. If a coating is applied, the plate may also feature a bituminous, silicone or similar external coating to provide additional sealing between the CMU 87 and the plates 88. FIG. 16 A shows a tendon 90 for each cavity that is connected to the plates 88 by the threaded apertures 98 in the plate 88. The unthreaded through hole 99 is the location to place the next tendon for connection to the lower plate. FIG. 16 B shows an alternative embodiment of the defensive UNITIZED POST TENSION BLOCK SYSTEM 87. Here, a plurality of tendons 90 may be used to create even greater post tensioning if desired. Additional tendons 90 would require correspondingly additional apertures 98, 99 in the anchor plates 88.

The details mentioned here are exemplary and not limiting. Stated again and well appreciated by one skilled in the art of construction materials, all the examples of the materials may be substituted with other plastics and composite materials that have similar properties and still be within the scope and spirit of this UNITIZED POST TENSION BLOCK SYSTEM FOR MASONRY STRUCTURES 31. Other components specific to describing a UNITIZED POST TENSION BLOCK SYSTEM FOR MASONRY STRUCTURES 31 may be added as a person having ordinary skill in the field of construction as being obvious from the above described embodiment.

Operation of the Preferred Embodiment

The new UNITIZED POST TENSION BLOCK SYSTEM 31 has been described in the above embodiment. The manner of how the device operates is described below. Note well that the description above and the operation described here must be taken together to fully illustrate the concept of the UNITIZED POST TENSION BLOCK SYSTEM 31.

FIG. 15 shows the process of assembly 86 for a UNITIZED POST TENSION BLOCK SYSTEM 31, including steps 1 through 12. The process shown is for a CMU with recessed channels 36, but the general flow is similar for all the different embodiments of the UNITIZED POST TENSION BLOCK SYSTEM 31. There are shown 12 steps shown in Table C that correspond to the steps shown in FIG. 15. These steps are then repeated as additional CMUs are needed for the desired structure.

TABLE C

Assembly Process

| Step | Description |
|---|---|
| 1 | Place two starter anchors/bars 33 on the ground or foundation surface |
| 2 | Place CMU 35 over the starter anchor/bars 33 |
| 3 | Place two more anchor/bars 33 into the upper extended recessed channels 36 of the CMU 35 |
| 4 | Place two tendon/through bolts 34 into the through apertures 99 in the uppermost anchor/bars 33 |
| 5 | Tighten the two tendon/through bolts 34 into the threaded apertures 98 in the lowermost starter anchor/bars 33 by means of a wrench or equal |
| 6 | Place two additional starter anchors/bars 33 next to the primary CMU 35 |
| 7 | Place the second CMU 35 over the second set of starter anchor/bars 33 |
| 8 | Place two more anchor/bars 33 into the upper extended recessed channels 36 of the second CMU 35 AND Place two more tendon/through bolts 34 into the through apertures 99 in the uppermost anchor/bars 33 of the second CMU 35 |
| 9 | Tighten (by means of a wrench or equal) the second set of two tendon/through bolts 34 into the threaded apertures 98 in the lowermost starter anchor/bars 33 placed under the second CMU 35 |
| 10 | Place the third CMU 35 over the first and second CMUs 35 straddling each equally (note this is for a running bond configured wall) |
| 11 | Place two more anchor/bars 33 into the upper extended recessed channels 36 of the third CMU 35 AND Place two more tendon/through bolts 34 into the through apertures 99 in the uppermost anchor/bars 33 of the third CMU 35 |
| 12 | Tighten (by means of a wrench or equal) the third set of two tendon/through bolts 34 into the threaded apertures 98 in the uppermost anchor/bars 33 of the first and second CMU 35 |
| | Repeat process until structure is completed. |

FIG. 17 shows an application for the heavy duty application 87A. In this example, a series of the heavy duty CMUs 89 are placed and assembled similarly as described in the process above in FIG. 15. However the anchor bars 33 are now full surface plates 88. The tendons 90 are high strength through bolts or other strong, durable tendons. Also, the initial base anchors may be of various configurations 91 for attachment into a concrete pad, direct to stone, or directly into the earth. These various configurations 91 may be of varying lengths to accommodate the construction needs. One notes well that these UNITIZED POST TENSION BLOCK SYSTEM 87 structures may be rapidly erected and later quickly disassembled for removal, transport, and re-use.

FIGS. 18 A through 18 E show sketches of applications for the heavy duty option 87 of the UNITIZED POST TENSION BLOCK SYSTEM 31. FIG. 18 A is a side view of heavy duty CMUs 89 arranged in a horizontal stack with the heavy duty plates 88 contained as anchors between each heavy duty CMU 89. While a short lateral deck or bridge 92 is depicted, one skilled in the art of construction appreciates how this example may be expanded for larger sections and structures. One also notes the need for some high strength support 93 at the ends of the deck 92. FIG. 18 B depicts the same example deck 92 with an applied load 94 from personnel, equipment or materials. The deck configuration here as well as the wall 87A described in FIG. 17 above lends itself to many different barricade, building, bridge and other strong protection structures for anti-terrorism and defensive military applications. This full plate 88 placed between heavy CMUs 89 is the key for such applications. Other uses are listed in the Table D, below.

A very special application for a heavy duty 87 UNITIZED POST TENSION BLOCK SYSTEM 31 is described in FIGS.

18 C through E. In FIG. 18 C, a vehicle used for military duty such as a truck 95 or halftrack is shown. The vehicle 95 has a bed or support structure 96 at its rear section where military personnel are often located. In FIG. 18 D the bed or structure 96 is repeated. Then, in FIG. 18 E, a special blast resistant or blast proof bed cover 97 or floor is installed. This floor is a heavy duty 87 UNITIZED POST TENSION BLOCK SYSTEM 31. The result is an easily installed protection that weighs much less than conventional armor plating several inches thick. The installation of the blast proof bed cover 97 can be accomplished quickly by the personnel using the vehicle. Confirmation testing by the military is required to ascertain whether this is a blast proof versus blast resistant alternative. However, the cost for a blast proof bed cover 97 compared to a pure steel alternative is considerably less and may be rapidly deployed for use.

Various other uses exist for the UNITIZED POST TENSION BLOCK SYSTEM 31 as described here in TABLE D—EXAMPLES OF USES. These other uses are similar to those covered by Bolt-A-Blok system of unitized post tensioning. However, the instant UNITIZED POST TENSION BLOCK SYSTEM 31 has the many additional improvements described above for these uses.

TABLE D

EXAMPLES OF USES

| ITEM | DESCRIPTION |
|---|---|
| 1 | All general construction.<br>Building Walls, fences, and construction partitions<br>Foundations<br>Piers under floors and bridges<br>Fireplaces and Flues<br>Retaining Walls<br>Decorative Panels - straight or curved<br>Vertical, horizontal, flat and curved wall<br>Self supporting columns<br>Use UNITIZED POST TENSION BLOCK SYSTEM 31 for constructing partition walls<br>Construct segments that can be pre-assembled to any size or shape. Then set in place with a crane, especially in areas where it is not safe to lay building units in a regular manner, such as atop buildings<br>Use with all standard lintels.<br>Roof deck<br>Steps for entry ways and multi-level buildings<br>Assemble UNITIZED POST TENSION BLOCK SYSTEM 31 walls in any configuration, silos, piers, boxes, walls, ell-walls, t-walls, u-shape walls, and square walls |
| 2 | Bridge, levy and highway<br>Levy/Dams Repair broken levies, make new levies, piers. Box shape, solid shape, U-shape, could nest larger and larger square piers or rectangle piers. Strengthen existing levies by putting UNITIZED POST TENSION BLOCK SYSTEM 31 made piers in front of existing walls. Re-enforcement can be positioned under water and need not show. Pre make and drop long units in place for levy control. Pull out with cable.<br>Bridge Structures Breakwater forms. Ultra strong forms for pouring concrete into. Bridge forms and piers. |
| 3 | Disaster and terrorism prevent/relief<br>Entrance Barriers - Such as Gates and vehicle control points<br>Safe room, Safe or Vault - easy builds in high rise structures<br>All structures that require more fire resistant, wind resistant, and attack resistant buildings.<br>Military and police use for blast protection, quick guard houses, quick prisons, detonation walls, etc.<br>Quick construction in third world countries, disaster areas, anywhere.<br>Use UNITIZED POST TENSION BLOCK SYSTEM 31 for rapidly replacing buildings in disaster areas<br>Wind and water resistant - Hurricane, Tornado Tsunami resistant |

TABLE D-continued

EXAMPLES OF USES

| ITEM | DESCRIPTION |
|---|---|
| | Anti-terror barricades at public buildings<br>Earthquake resistant |
| 4 | Other<br>Store and garden commercial display units<br>Tank walls - such as Swimming pools, fire water tanks, waste water tanks<br>Mobile and/or Manufactured home Building skirts<br>Sound-proof or noise attenuation walls and structures<br>Paint and hazardous material containment structures<br>Desert application, below freezing applications, below water applications, mines. Use in caissons, for underwater construction.<br>Surveyor monuments, mail box posts. bases for equipment such as propane tanks and air conditioning units, wing walls, retaining walls, motels, fire walls, storage unit buildings, schools. |

With this description of the detailed parts and operation it is to be understood that the UNITIZED POST TENSION BLOCK SYSTEM 31 is not to be limited to the disclosed embodiment. The features of the UNITIZED POST TENSION BLOCK SYSTEM 31 are intended to cover various modifications and equivalent arrangements included within the spirit and scope of the description.

What is claimed is:

1. A construction system, comprising:

a) a plurality of masonry units, each of the plurality of masonry units having an uppermost and lowermost plane and a hollow cavity formed between and extending from the uppermost plane to the lowermost plane, wherein the uppermost and lowermost planes are substantially parallel to one another;

b) at least two anchor bars, each of the at least two anchor bars having a threaded aperture and a comparatively larger non-threaded aperture, a first bar of the at least two anchor bars placed contiguously to the lowermost plane and a second bar of the least two anchor bars placed contiguously to the uppermost plane, wherein the first bar and second bar are placed substantially parallel to each other; and c) a plurality of fasteners configured to rigidly and removably connect to each of the at least two anchor bars, first to said first bar of the at least two anchor bars directly above, and second to said second bar of the at least two anchor bars directly below, wherein each of the plurality of masonry units comprises at least one recess formed at the uppermost plane and having a substantially uniform recess depth; and wherein each of the at least two anchor bars has a substantially uniform thickness corresponding to the substantially uniform recess depth, such that an anchor bar surface of the at least two anchor bars is substantially flush with the uppermost plane when one of the at least two anchor bars is inserted into the at least one recess; and wherein connection of fasteners to each of the at least two anchor bars, first to said first bar of the at least two anchor bars directly above, and second to said second bar of the at least two anchor bars directly below, yields a post tensioned masonry unit therebetween.

2. The construction system according to claim 1, wherein the at least one recess is recessed channel extending from one outer perimeter surface of each of the plurality of masonry units to another outer perimeter surface of each of the plurality of masonry units.

3. The construction system according to claim 1, wherein the at least one recess is a pocket recess that does not extend to an outer perimeter surface of each of the plurality of masonry units.

4. The construction system according to claim 1, wherein the recess is formed in a lateral direction across a width of each of the plurality of masonry units.

5. The construction system according to claim 4, wherein the recess is a first recess, and wherein a second recess is formed in a longitudinal direction across a length of each of the plurality of masonry units.

6. The construction system according to claim 1, wherein the recess is formed in a longitudinal direction along a length of each of the plurality of masonry units.

7. The construction system according to claim 6, wherein the recess is a first recess, and wherein a second recess is formed in a lateral direction across a width of each of the plurality of masonry units.

8. The construction system according to claim 1, wherein the at least two anchor bars comprise a sloped portion to locate a first fastener of the plurality of fasteners, and wherein the sloped portion assists guiding of the first fastener into the threaded aperture of one of the at least two anchor bars.

9. The construction system according to claim 1, wherein the plurality of masonry units is two or more rows of concrete masonry units, and wherein at least one of the two or more rows of concrete masonry units is wider than an adjacent row above or below the at least one of the two or more rows.

10. The construction system of claim 1, wherein each of the plurality of fasteners has a length sufficient to extend continuously through the hollow cavity from above the uppermost plane to below the lowermost plane.

11. The construction system of claim 10, wherein when one of the plurality of fasteners is rigidly and removably connected first to said first bar of the at least two anchor bars directly above, and second to said second bar of the at least two anchor bars directly below, the one of the plurality of fasteners extends continuously through the hollow cavity from above the uppermost plane to below the lowermost plane.

12. The construction system of claim 1, wherein the at least one recess has a completely uniform recess depth and each of the at least two anchor bars has a completely uniform thickness corresponding to the completely uniform recess depth.

13. A construction system, comprising:

a) a plurality of masonry units, each of the plurality of masonry units having an uppermost and lowermost plane and a hollow cavity formed between and extending from the uppermost plane to the lowermost plane, wherein the uppermost and lowermost planes are substantially parallel to one another;

b) at least two anchor bars, each of the at least two anchor bars having a threaded aperture and a comparatively larger non-threaded aperture, wherein a first anchor bar of the at least two anchor bars is embedded within a first masonry unit of the plurality of masonry units, such that the first masonry unit substantially prevents movement in any direction of the first anchor bar with respect to the first masonry unit, wherein a second anchor bar of the at least two anchor bars is embedded within a second masonry unit of the plurality of masonry units, such that the second masonry unit substantially prevents movement in any direction of the first anchor bar with respect to the first masonry unit, wherein the first anchor bar does not protrude beyond an outer perimeter surface of the first masonry unit, wherein the second anchor bar does not protrude beyond an outer perimeter surface of the second masonry unit, and wherein the first anchor bar and second anchor bar are placed substantially parallel to each other; and c) a plurality of fasteners configured to rigidly and removably connect to each of the at least two anchor bars with the threaded aperture and the comparatively larger non-threaded aperture, first to the first anchor bar directly above, and second to the second anchor bar directly below, to yield a post tensioned masonry unit therebetween.

14. The construction system according to claim 13, wherein the first anchor bar is embedded in a lateral direction across a width of the first masonry unit, and wherein the second anchor bar is embedded in a lateral direction across a width of the second masonry unit.

15. The construction system according to claim 14, wherein a third anchor bar of the at least two anchor bars is embedded in a longitudinal direction across a length of the first masonry unit, and wherein a fourth anchor bar of the at least two anchor bars is embedded in a longitudinal direction across a length of the second masonry unit.

16. The accessories according to claim 13, wherein the first anchor bar is embedded in a longitudinal direction across a length of the first masonry unit, and wherein the second anchor bar is embedded in a longitudinal direction across a length of the second masonry unit.

17. The construction system according to claim 16, wherein a third anchor bar of the at least two anchor bars is embedded in a lateral direction across a width of the first masonry unit, and wherein a fourth anchor bar of the at least two anchor bars is embedded in a lateral direction across a width of the second masonry unit.

18. The construction system according to claim 13, wherein the at least two anchor bars comprise a sloped portion to locate a first fastener of the plurality of fasteners, and wherein the sloped portion assists guiding of the first fastener into the threaded aperture of one of the at least two anchor bars.

19. The construction system according to claim 13, wherein the plurality of masonry units is two or more rows of concrete masonry units, and wherein at least one of the two or more rows of concrete masonry units is wider than an adjacent row above or below the at least one of the two or more rows.

20. A construction system, comprising:

a) a plurality of masonry units, each of the plurality of masonry units having an uppermost and lowermost plane and a hollow cavity formed between and extending from the uppermost plane to the lowermost plane, wherein the uppermost and lowermost planes are substantially parallel to one another;

b) at least two anchor bars, each of the at least two anchor bars having a threaded aperture and a comparatively larger non-threaded aperture, a first bar of the at least two anchor bars placed contiguously to the lowermost plane and a second bar of the at least two anchor bars placed contiguously to the uppermost plane, wherein the first bar and second bar are placed substantially parallel to each other, and at least one of the at least two anchor bars has a length greater than the length of the masonry unit; and c) a plurality of fasteners configured to rigidly and removably connect to each of the at least two anchor bars, first to said first bar of the at least two anchor bars directly above, and second to said second bar of the at least two anchor bars directly below, wherein each of the plurality of masonry units comprises at least one recess formed at the uppermost plane and having a substantially uniform recess depth, the at least one recess formed in a longitudinal direction along a length of each of the plurality of masonry units;

wherein each of the at least two anchor bars has a substantially uniform thickness corresponding to the substantially uniform recess depth, such that an anchor bar surface of the at least two anchor bars is substantially flush with the uppermost plane when one of the at least two anchor bars is inserted into the at least one recess; and wherein connection and post tensioning of respective fasteners to each of the at least two anchor bars, first to said first bar of the at least two anchor bars directly above, and second to said second bar of the at least two anchor bars directly below, yields a masonry unit under compression therebetween.

21. The construction system of claim 20, wherein each of the plurality of fasteners has a length sufficient to extend continuously through the hollow cavity from above the uppermost plane to below the lowermost plane.

22. The construction system of claim 21, wherein when one of the plurality of fasteners is rigidly and removably connected first to the first bar of the at least two anchor bars directly above, and second to the second bar of the at least two anchor bars directly below, the one of the plurality of fasteners extends continuously through the hollow cavity from above the uppermost plane to below the lowermost plane.

23. The construction system of claim 20, wherein the at least one recess has a completely uniform recess depth and each of the at least two anchor bars has a completely uniform thickness corresponding to the completely uniform recess depth.

* * * * *